US005986260A

United States Patent [19]

Oonuma et al.

[11] Patent Number: 5,986,260

[45] Date of Patent: Nov. 16, 1999

[54] MASS ANALYZER

[75] Inventors: Mitsuru Oonuma, Tokyo; Seiji Kamimura, Kokubunji; Tadao Mimura, Hitachinaka, all of Japan

[73] Assignee: Hitachi, Ltd., Tokyo, Japan

[21] Appl. No.: 08/921,365

[22] Filed: Aug. 29, 1997

[30] Foreign Application Priority Data

Aug. 30, 1996 [JP] Japan ..... 8-229816

[51] Int. Cl.[6] ..... H01J 49/04

[52] U.S. Cl. ..... 250/288; 250/281; 250/292; 250/289

[58] Field of Search ..... 250/288, 288 A, 250/281, 292, 289; 73/23.37; 313/359.1

[56] References Cited

U.S. PATENT DOCUMENTS 5,686,655 11/1997 Itoi ..... 250/288

5,756,996 5/1998 Bier et al. ..... 250/292

*Primary Examiner*—Jack I. Berman

*Attorney, Agent, or Firm*—Antonelli, Terry Stout & Kraus, LLP

[57] ABSTRACT

A mass analyzer comprising a sample preparation mechanism for preliminarily preparing an analyzing sample, an interface mechanism for preparing the sample into ions after the required preliminary preparation, an ion trapping part and analyzing part for analyzing the ions, and a controller. The ion trapping part and analyzing part is placed in a box portion of the body, while the interface mechanism is arranged on the front top of the box portion of the body. When the cover at the front top is removed, the front, top and right side of the interface mechanism are opened.

18 Claims, 19 Drawing Sheets

MASS ANALYZER

BACKGROUND OF THE INVENTION

The present invention relates to a mass analyzer.

Generally, mass analyzers are divided as a group for liquid chromatography and as a group for gas chromatography, and the analyzers therefor comprise a sample preparation mechanism for preliminarily preparing an analyzing sample, an interface mechanism for preparing the sample into a vapor or ions; an analyzing part for introducing the ions to an ion trapping part under controls of a high frequency electric field through an electrostatic lens and an ion guide and detecting the output ions from the ion trapping part whereby the mass of the sample grains is analyzed, and a controller for giving necessary set-up values individually to these members or controlling these members.

The interface mechanism includes ionizers, known and called as electro-spray ionizer (ESI), atomic pressure chemical ionizer (APCI) or sonic spray ionizer (SSI). These ionizers principally comprise a vaporizer or a nebulizer which works to vaporize or nebulize a sample by purging the sample into the ionizers at a state with a high voltage applied, and an ionizing electrode. Furthermore, these members are heated at about 150 degrees to 400 degrees during use (during operation).

FIG. 20 is a block diagram depicting the whole structure of a mass analyzer; and FIG. 21 is a perspective view depicting the arrangement of the interface mechanism in the mass analyzer. With references to FIGS. 20 and 21, the problems occurring in arranging the interface mechanism according to prior art will be described hereinbelow. In FIG. 20, 100 represents a sample preparation mechanism for preliminarily preparing an analyzing sample, where the sample is preliminarily treated for necessary preparation such as dust removal and the like. 200 represents an interface mechanism to vaporize or ionize the sample. 300 represents an ion trapping part and analyzing part to analyze the ions. 400 represents a controller to give necessary set-up values to such individual members and collect the data of the conditions of the individual members to give control signals. Also, the controller collects the analysis results.

In FIG. 21, the interface mechanism 200 and the ion trapping part and analyzing part 300 are placed in box 1 of the body, but in the figure, practically, only vaporizer 2 or nebulizer 6 (not shown in the figure) and ionizing electrode 3 of the interface mechanism 200, fixing screws 4, 4', vacuum duct 5, and tube 7 are shown, after top plate 17 and the box 1 are cutaway. Although not represented in the figure because of omission, power source cables are connected to the ionizing electrode 3 and the nebulizer 6 of the interface mechanism 200 so as to supply a necessary voltage to them. The sample preparation mechanism 100 and the controller 400 are mounted on a control desk, not shown in the figure, which is placed on the top of top plate 17 or placed adjacent to the box 1 of the body. A sample prepared by means of the sample preparation mechanism 100 is transferred through the tube 7 to the interface mechanism 200 for analysis. Within the box 1 of the body, furthermore, mass analyzing part 300 comprising an electrostatic lens, an ion guide, an ion trap and a detector, not shown in the figure, as well as a vacuum pump, a power source and a control circuit as the auxiliary devices thereof, are placed.

SUMMARY OF THE INVENTION

As apparently understood with reference to FIG. 21, the interface mechanism 200 is placed inside the box 1 of the body. When intending to do a maintenance work or an exchange work of the interface mechanism 200, therefore, a removable lid or an opening and closing hatch, which is placed on the same plane that the top plate 17 is placed, as shown at the cutaway state thereof in FIG. 21, should be opened to draw out the interface mechanism 200 for maintenance work or exchange work of the interface mechanism to new interface mechanism 200. In FIG. 21, also, the side of the box 1 of the body is shown at a cutaway state, but practically, the side thereof is not cutaway. Hence, the maintenance or exchange work of such interface mechanism causes very cramped feeling. Because connecting cables are connected to the vacuum duct 5 to make the inside of the interface mechanism at a medium degree of vacuum and to the ionizing electrode 3 in the interface mechanism, furthermore, the exchange of the interface mechanism is so laborious.

It is an object of the present invention to provide a mass analyzer, wherein the interface mechanism 200 can be readily maintained by decomposition, cleaning and part exchange or the interface mechanism 200 can be readily exchanged to a new one so as to meet the change of ionizing process depending on the change of a sample and wherein the positioning thereof can be readily carried out for assembly.

In accordance with the present invention, the above object can be realized by preparing the structure of an interface mechanism requiring maintenance and exchange such that the interface mechanism can be kept at an open state on the front face of the box 1 of the body.

DESCRIPTION OF THE PREFERRED EMBODIMENTS

The mass analyzer of the present invention will now be described below in the following embodiments with reference to drawings.

Figure 1:
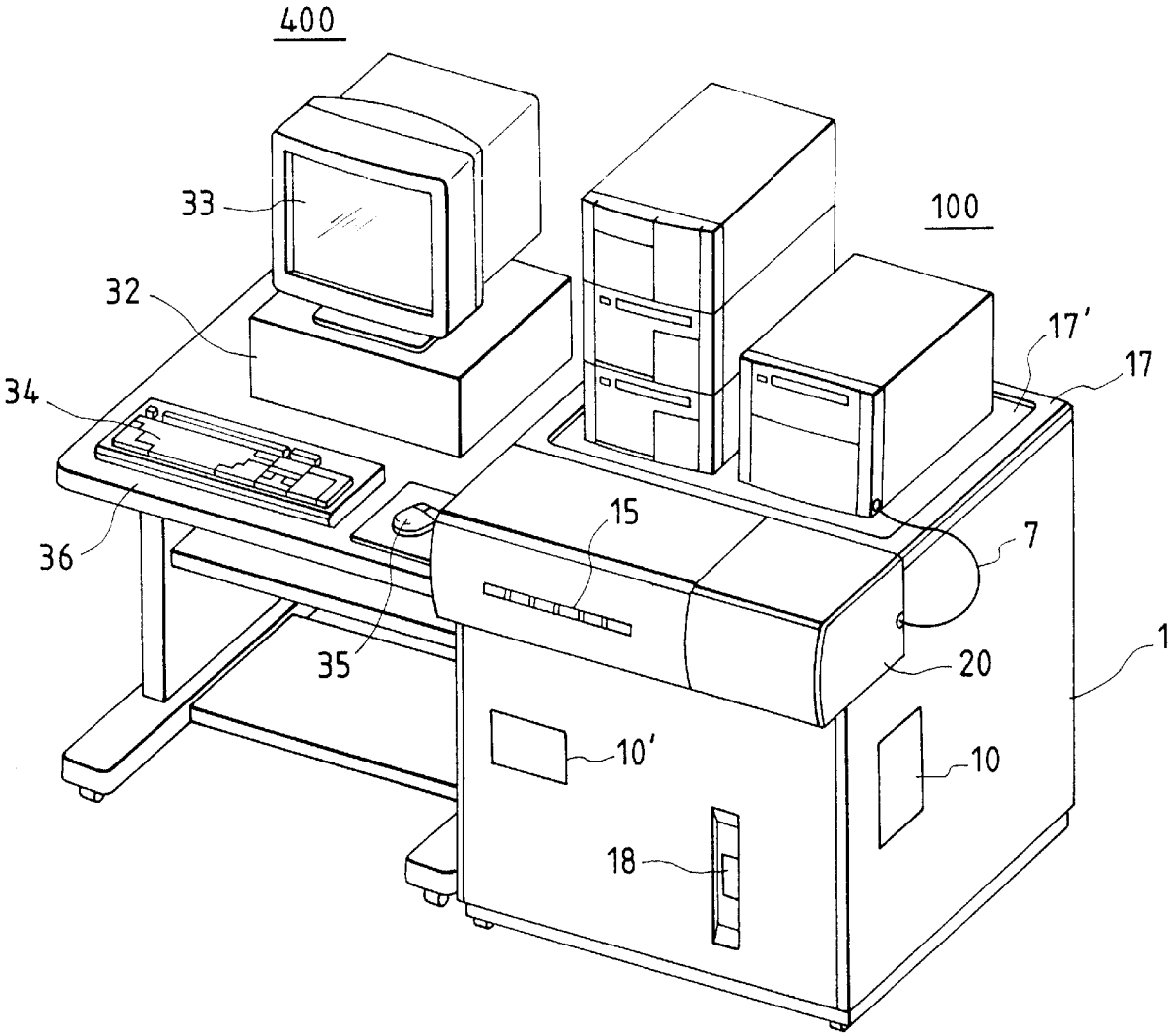
FIG. 1 is a perspective view depicting the whole composition the mass analyzer in accordance with the present invention.
Figure 20:
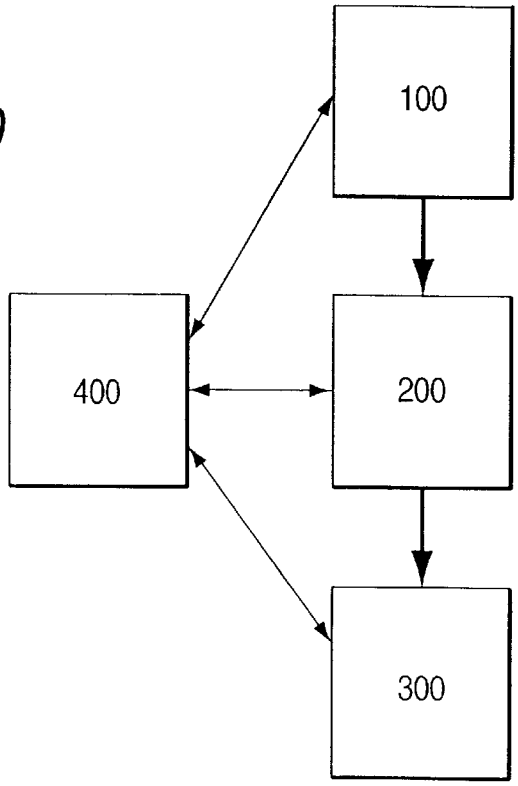
FIG. 20 is a block diagram depicting the whole composition of a mass analyzer.

FIG. 1 is a perspective view depicting the whole composition of the mass analyzer in accordance with the present invention. In the embodiment shown in FIG. 1, sample preparation mechanism 100 is mounted on recess part 17' on top plate 17 arranged on box 1 of the body, while controller 400 is arranged on desk 36 arranged adjacent to the box 1 of the body. The controller 400 comprises personal computer control part 32, display 33 displaying control status and data status, and keyboard 34 and mouse 36 inputting instructions and the like to the personal computer control part 32. As shown in FIG. 20, the controller 400 is in communication with individual members of the mass analyzer to give signals to these members or to process the data from these members. Interface mechanism 200 is placed at front lid 20 on the front top of the box 1 of the body. As the interface mechanism 200 is connected to the sample preparation mechanism 100 by means of tube 7, a sample after preliminary preparation is transferred to the interface mechanism 200. Ion trapping part and analyzing part 300 is placed inside the box 1 of the body. Door 10 is arranged on the side of the box 1 of the body, while door 10' and transparent window 18 are arranged on the front thereof. The door 10 is used as an oil supply opening of a hydraulic oil for a turbo molecule pump for vacuum discharge; and the door 10' is used for operation of power source switches and the like; and the transparent window 18 on the front is used for monitoring the hydraulic oil of the turbo molecule pump. These are utilized for controlling the vacuum pumps at the ion trapping part and analyzing part 300. 15 represents display device for displaying the on-off conditions of the pumps placed inside the box 1 of the body.

Figure 2:
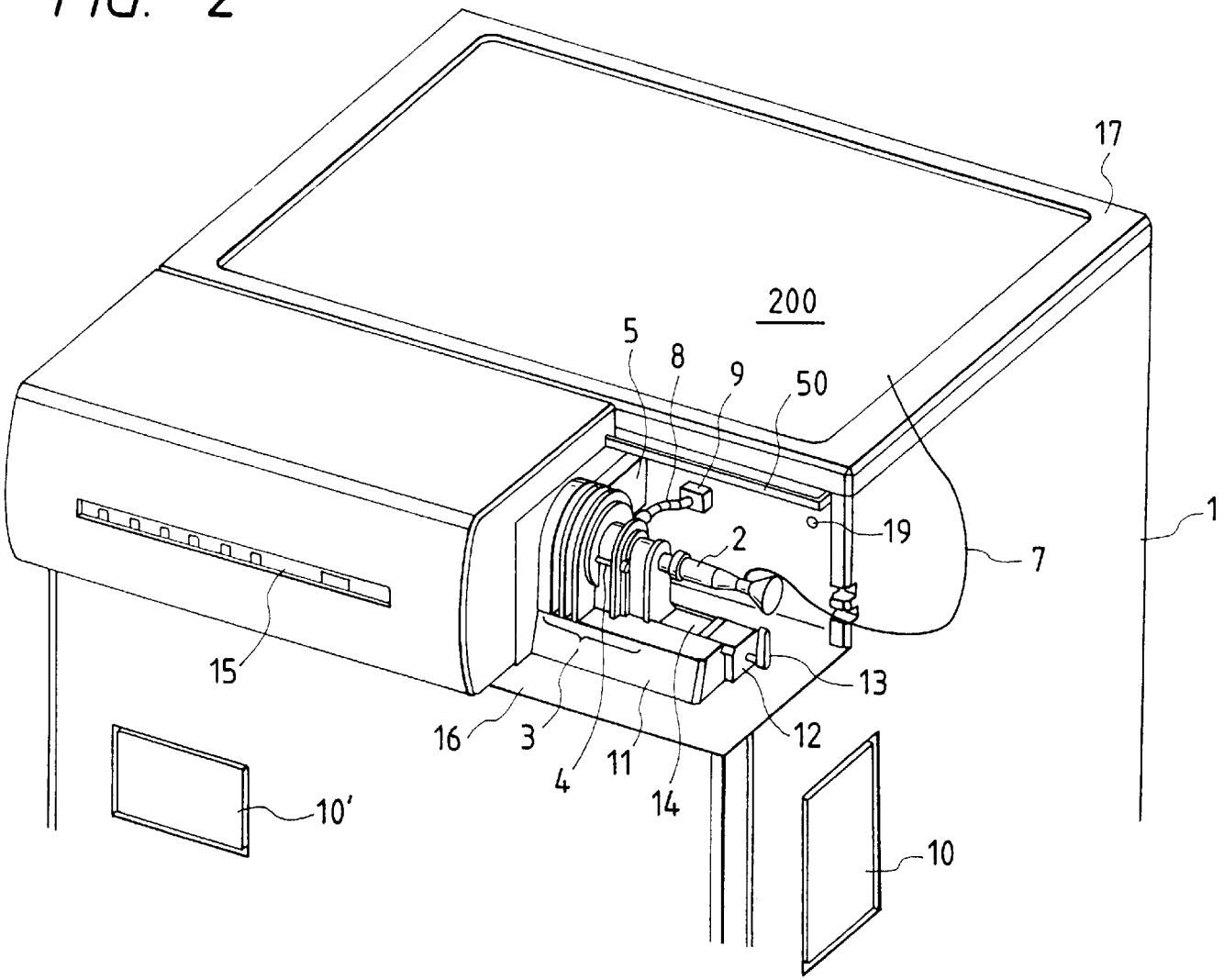
FIG. 2 is a perspective view depicting the composition of the interface mechanism of the mass analyzer in a first embodiment of the present invention.
Figure 3:
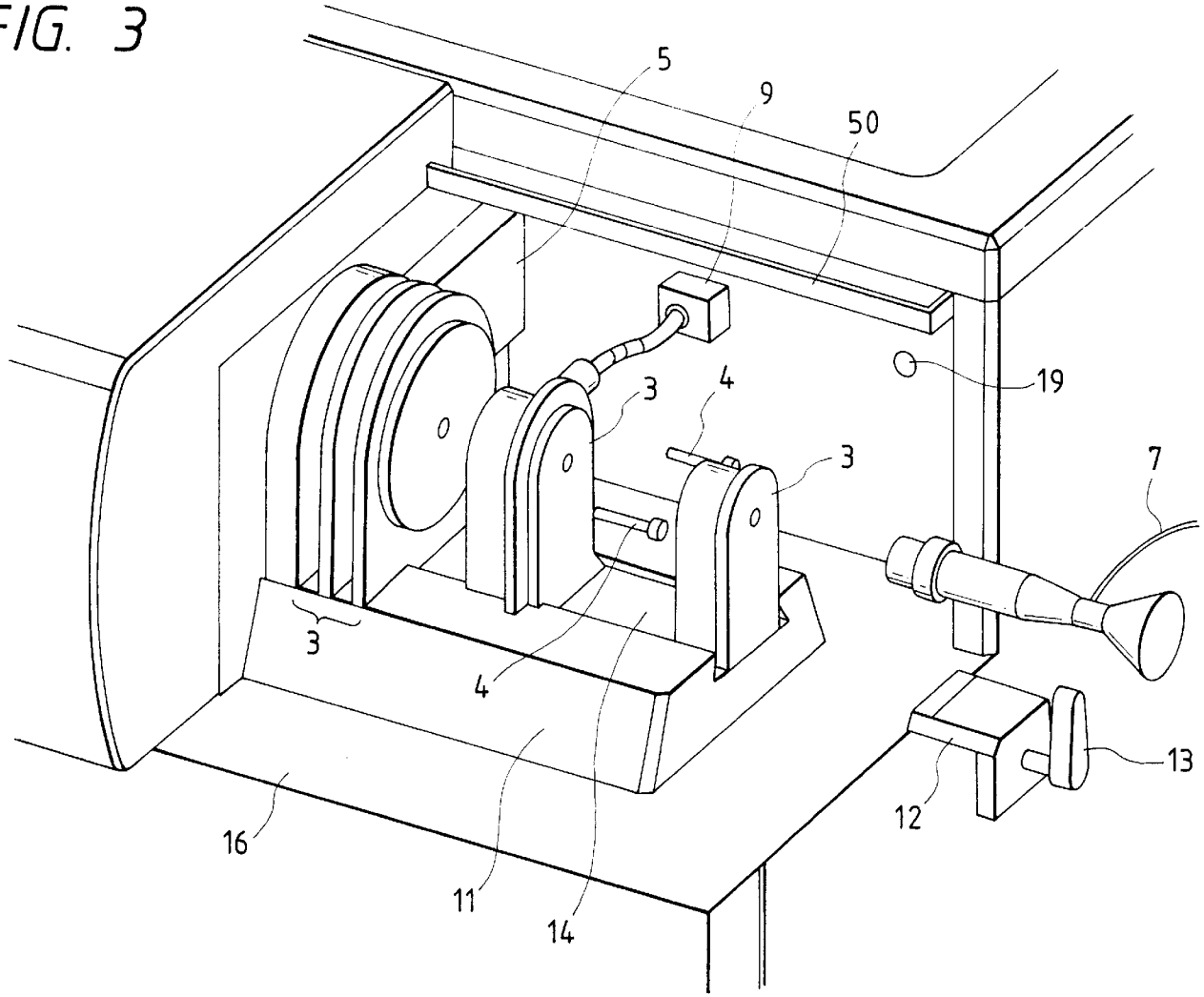
FIG. 3 is decomposition view of the interface mechanism of FIG. 2.

FIG. 2 is a perspective view depicting the composition of the interface mechanism 200 of the mass analyzer in the first embodiment of the present invention, and FIG. 3 is an enlarged decomposition view of the interface mechanism 200 of FIG. 2. FIG. 2 depicts the interface mechanism when removable front lid 20 protruding forward on the upper front of the box 1 of the body is drawn out from the right side of the box 1 of the body by sliding the lid on rail 50. Inside a part protruding forward on the upper front of the box 1 of the body, where the display device 15 is placed, the ion trapping part and analyzing part 300 is placed on a line extending from the interface mechanism 200.

In the present embodiment, the lower end of the ionizing electrode 3 is formed in a rectangular shape to be engaged in groove part 14 of table 11 arranged on plane plate 16 of the box 1 of the body. As apparently shown in the figure, in the present embodiment, the top, front and right side of the box 1 of the body are partially opened when the front lid 20 is removed, to expose the interface mechanism 200, whereby the maintenance work of the interface mechanism 200 can be done readily from the three sides and the decomposition and assembly of the interface mechanism 200 can be carried out at an extremely high working efficiency. Furthermore, the front lid 20 may satisfactorily be of a structure such that not the three sides of the interface mechanism but two sides thereof are open. As shown in FIG. 3, herein, individual fine pore electrodes composing the ionizing electrode 3 can slide by the guide of the groove part 14 arranged on the table 11, and additionally, the individual fine pore electrodes are arranged in engagement to the inside of the groove part 14, whereby the positioning of the central fine pores can be done. At a state during use, then, the individual fine pore electrodes composing the ionizing electrode 3 are wholly fixed on the face of the vacuum duct 5 by means of fixing screw 4, and additionally, the individual fine pore electrodes 3 are pressed against the face of the vacuum duct 5 by means of stopper 12 with stopper lever 13 in engagement to the groove part 14, starting from the end of the table 11. Screw 4' for fixing the vacuum duct 5 is not shown.

Into the individual fine pore electrodes composing the ionizing electrodes 3 and vaporizer 2 is transferred a preliminarily prepared sample through the tube 7, while a power source inside the box 1 of the body applies a given voltage through the cable 8 and connector 9 to the electrodes and vaporizer 2. Wiring of a power source for a heater arranged in the vaporizer 2 but not shown in the figure and for a sensor measuring the temperature is arranged in the cable 8 and is then connected through the connector 9 to the inside of the box 1 of the body. Furthermore, the groove part 14 arranged on the table 11 has a cross sectional shape of trapezoid so as to prevent the upper removal of the individual fine pore electrodes of an approximate trapezoid at an engaged state into the groove part 14.

The mass analyzer of the present invention has such a body to be used in common to various types of samples, by selecting an ionizer corresponding to the sample. Therefore, it should be designed that the controller 400 can detect automatically the cable selected depending on the ionizer, to reduce error in operation. The point will be described hereinafter in describing examples of the cable.

In accordance with the first embodiment of the present invention, the decomposition works for cleaning and exchange and the like of the ionizing electrode 3 and the vaporizer 2, both composing the interface mechanism, can be readily carried out by removing the fixing screw 4 thereby removing the stopper 12 and then sliding individually a plurality of the fine pore electrodes composing the ionizing electrode 3 in the groove part 14. Additionally, the assembly works thereafter can be carried out by sliding the individual members inside the groove part 14, whereby the individual members are securely positioned without any concern to the positioning.

Figure 4:
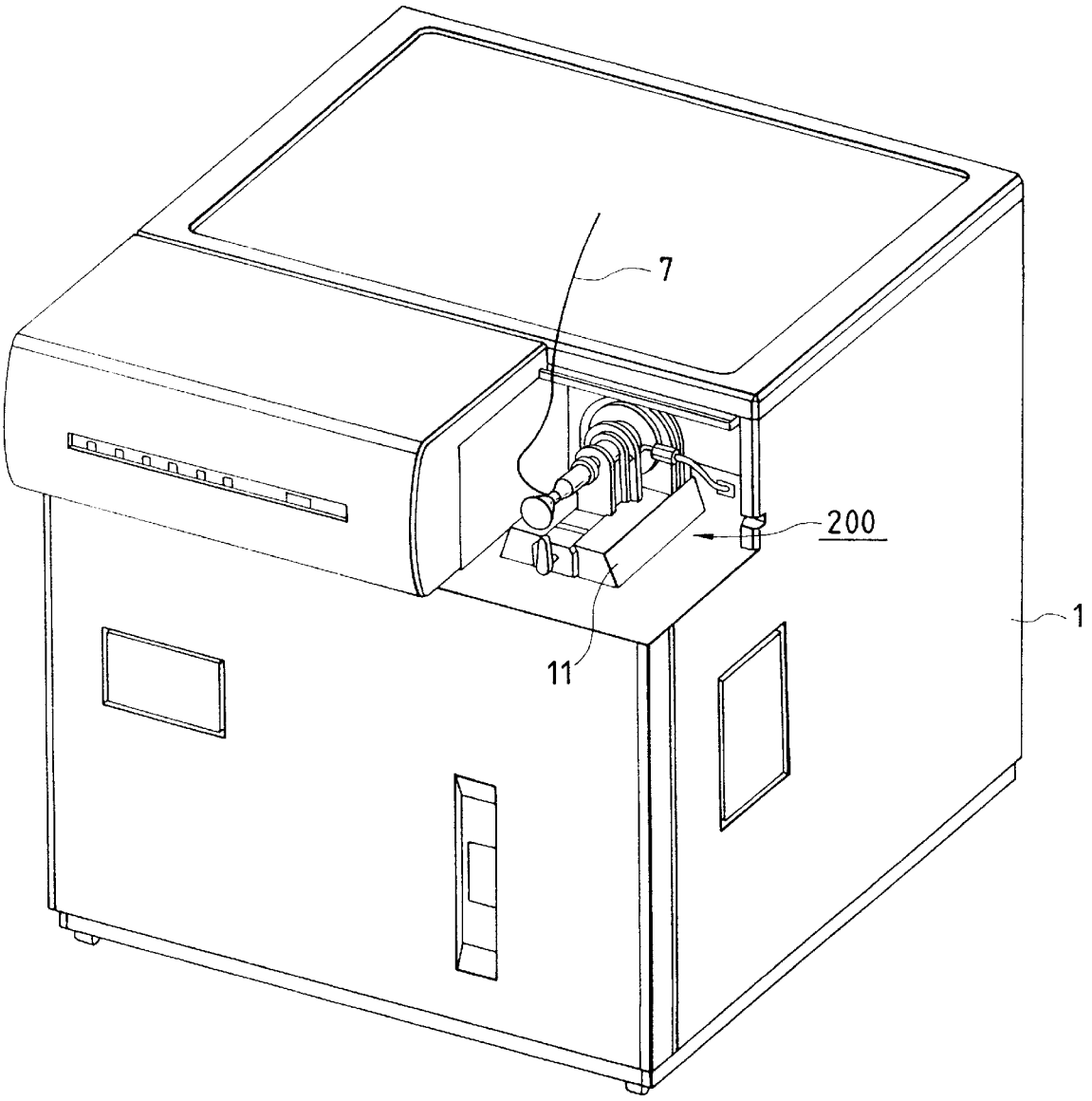
FIG. 4 is a perspective view of the composition of the interface mechanism of a mass analyzer in an embodiment wherein the direction of mounting the interface mechanism of the embodiment shown in FIG. 2 is modified by 90 degrees.
Figure 5:
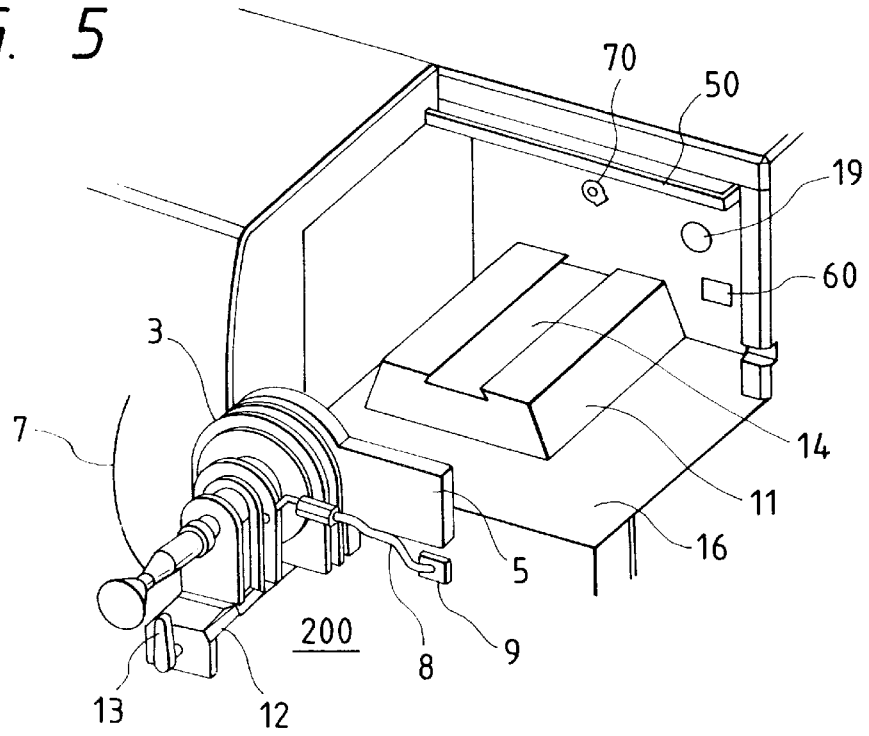
FIG. 5 is a view depicting the interface mechanism of FIG. 4 at a state as drawn out for exchange.

FIGS. 4 and 5 depict an example wherein the direction of mounting the interface mechanism shown in FIGS. 2 and 3 is modified by 90 degrees; and in FIG. 5, the interface mechanism is shown at a state wherein the mechanism is drawn out for exchange. In the embodiment shown in FIG. 4, the ion trapping part and analyzing part 300 which is arranged on the front part of the box 1 of the body in FIG. 2 should be arranged on a line extending from the interface mechanism 200 toward the depth direction in FIG. 4, because the ionized sample proceeds toward the depth direction of the box 1 of the body. In FIG. 5, those with the same symbols as in FIGS. 2 and 3 represent the same matters as in those figures. In FIG. 5, 60 represents a connection terminal of the cable connector 9; and 70 represents an opening part of the ion trapping part not shown in the figure.

Figure 7:
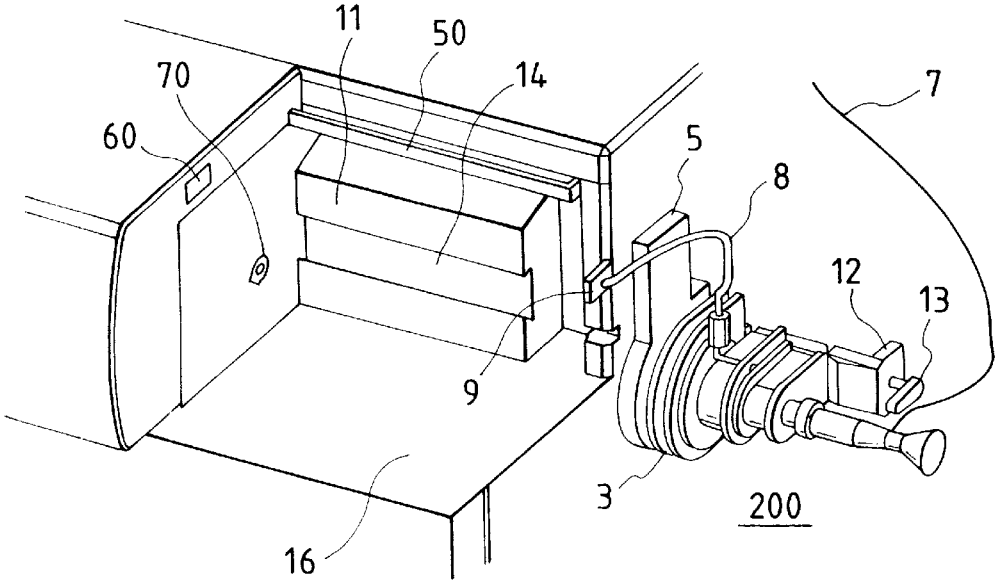
FIG. 7 is a view depicting the interface mechanism of FIG. 6 at a state as drawn out for exchange.
Figure 6:
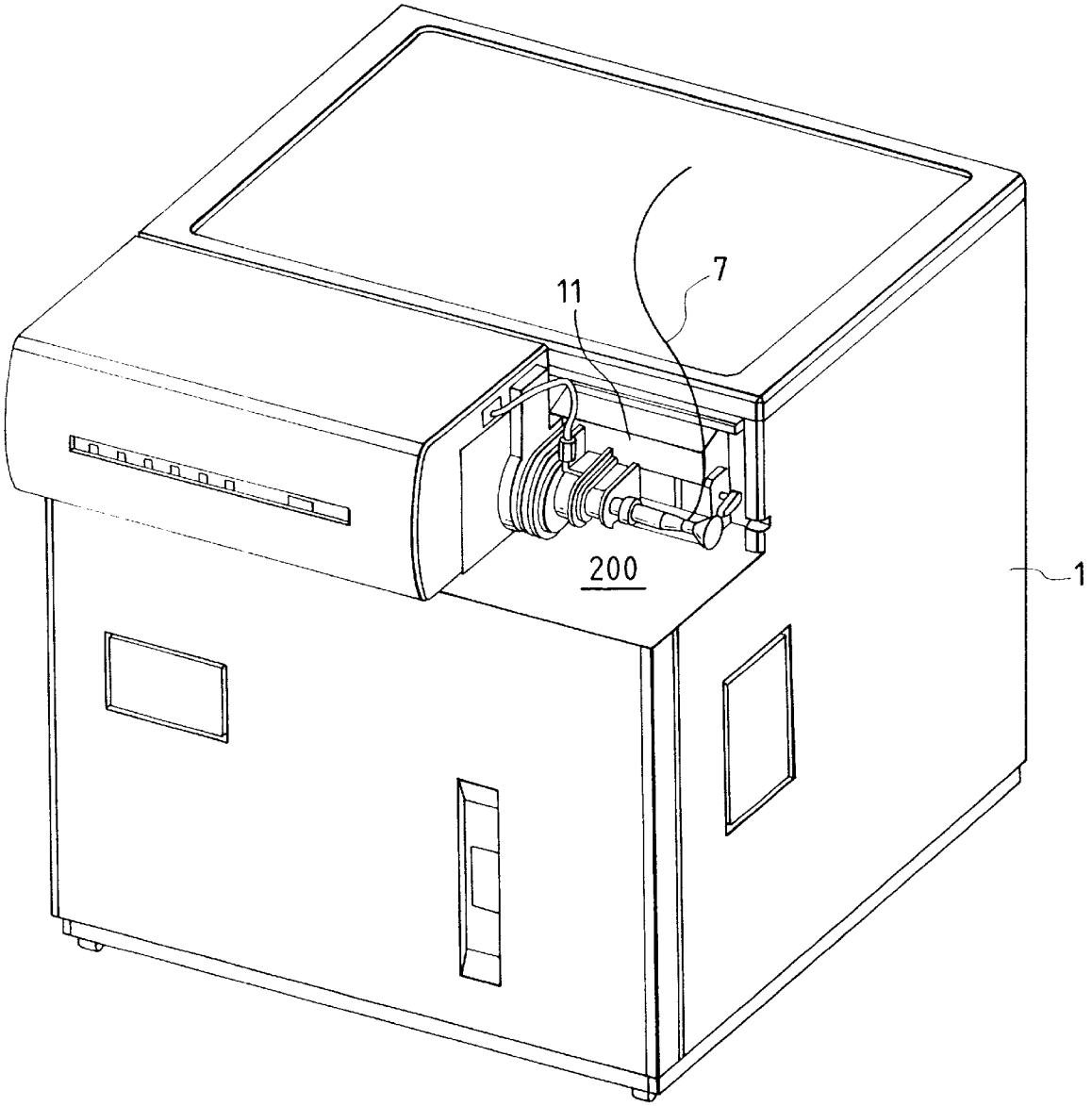
FIG. 6 is a perspective view of the composition of the interface mechanism of a mass analyzer in an embodiment wherein the face of mounting the interface mechanism of the embodiment shown in FIG. 2 is modified by 90 degrees.

FIGS. 6 and 7 depict an example wherein the face of mounting the interface mechanism of the embodiment shown in FIGS. 2 and 3 is modified by 90 degrees; and in FIG. 7, the interface mechanism 200 is shown at a state as drawn out for exchange. In the embodiment, the interface mechanism 200 is arranged on a vertical face in the depth of a part of the box 1 of the body, where the interface mechanism 200 is to be arranged, but the flow of the ionized sample is the same as in the embodiment of FIG. 2. In FIG. 7, those with the same symbols as in FIGS. 2 and 3 represent the same matters as in those figures. In FIG. 7, 60 represents connection terminal of cable connector 9; and 70 represents an opening part of an ion trapping part not shown in the figure.

Figure 8:
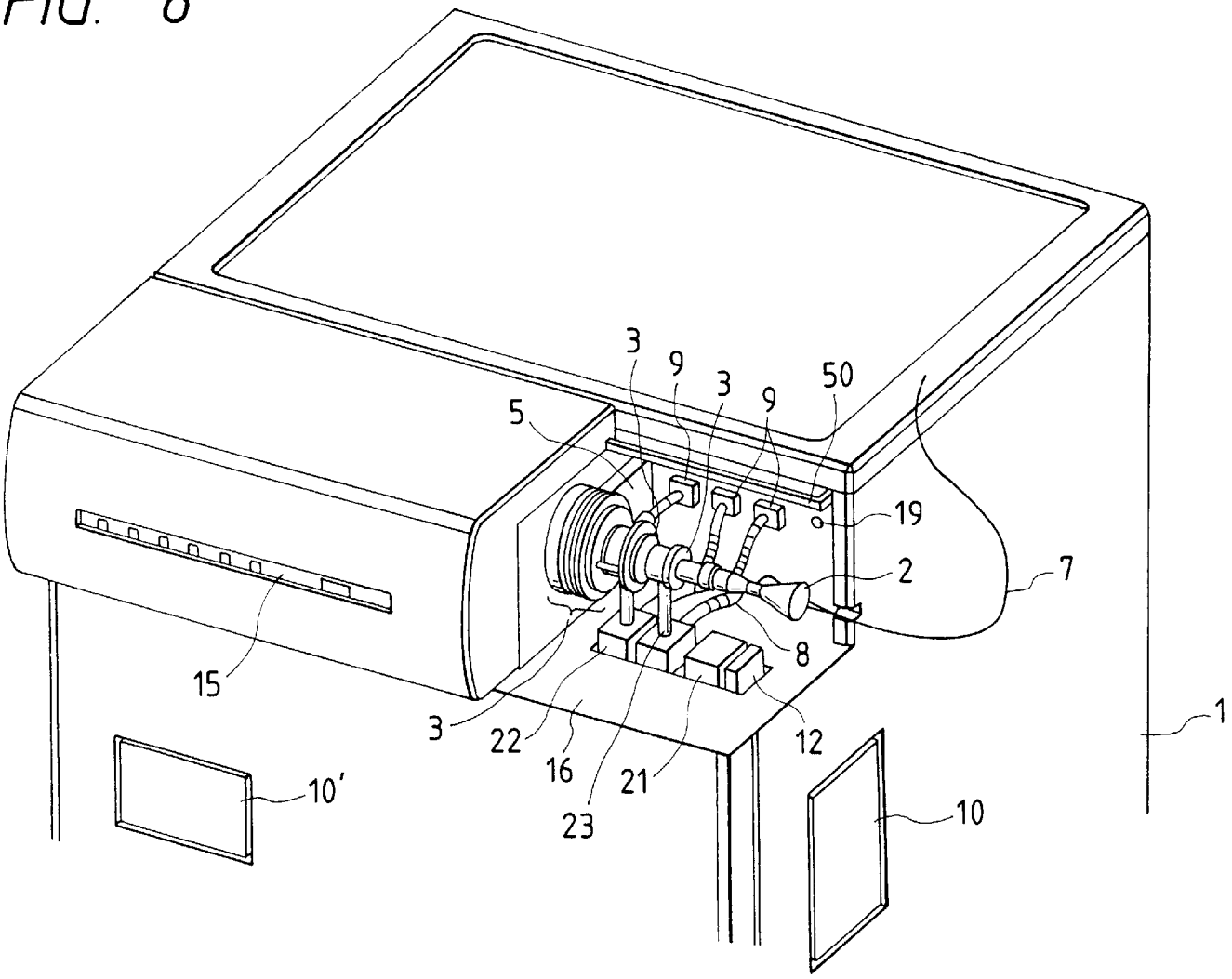
FIG. 8 is a perspective view of the composition of the interface mechanism of the mass analyzer of the second embodiment in accordance with the present invention.
Figure 9:
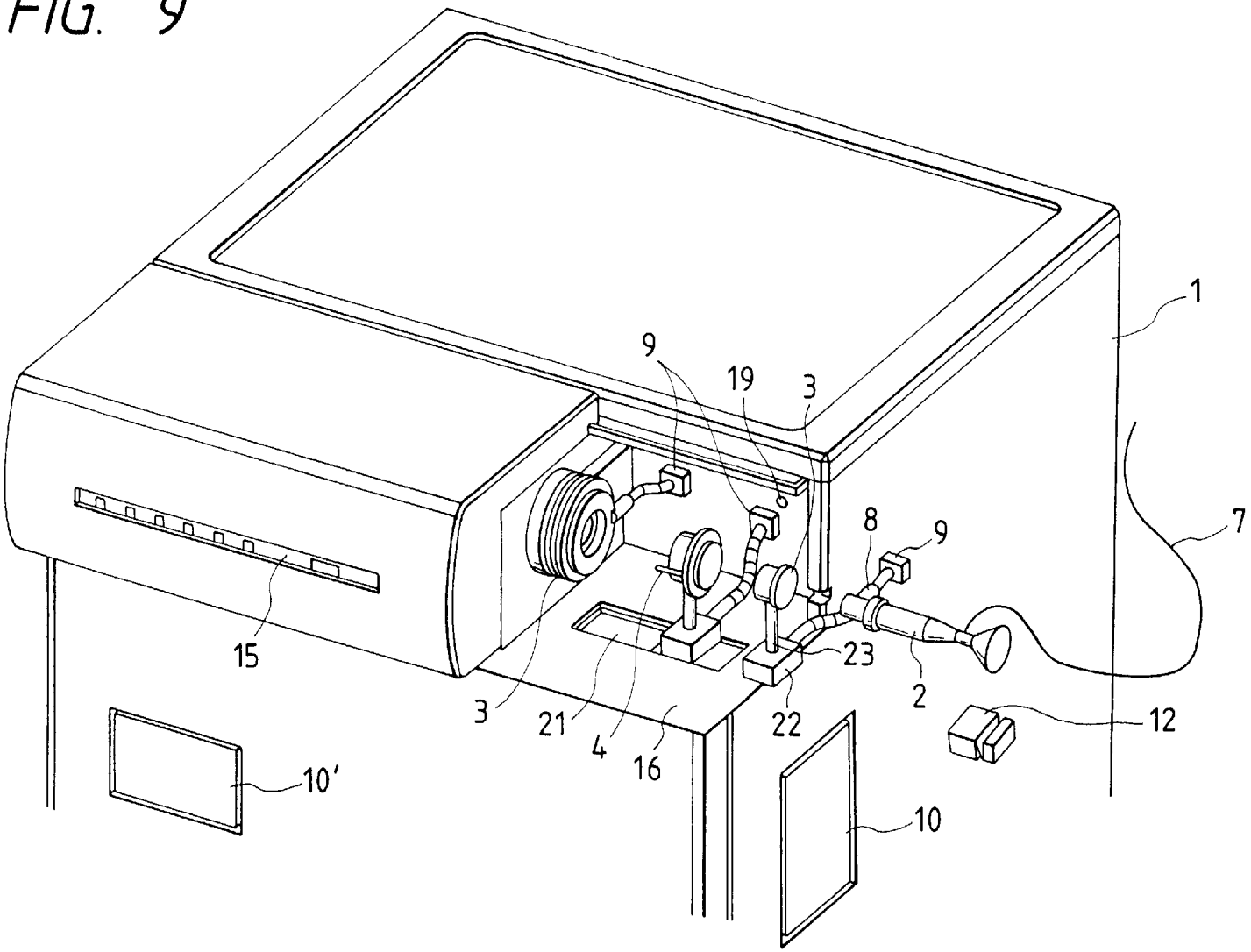
FIG. 9 is a decomposition view of the interface mechanism of FIG. 8.
Figure 21:
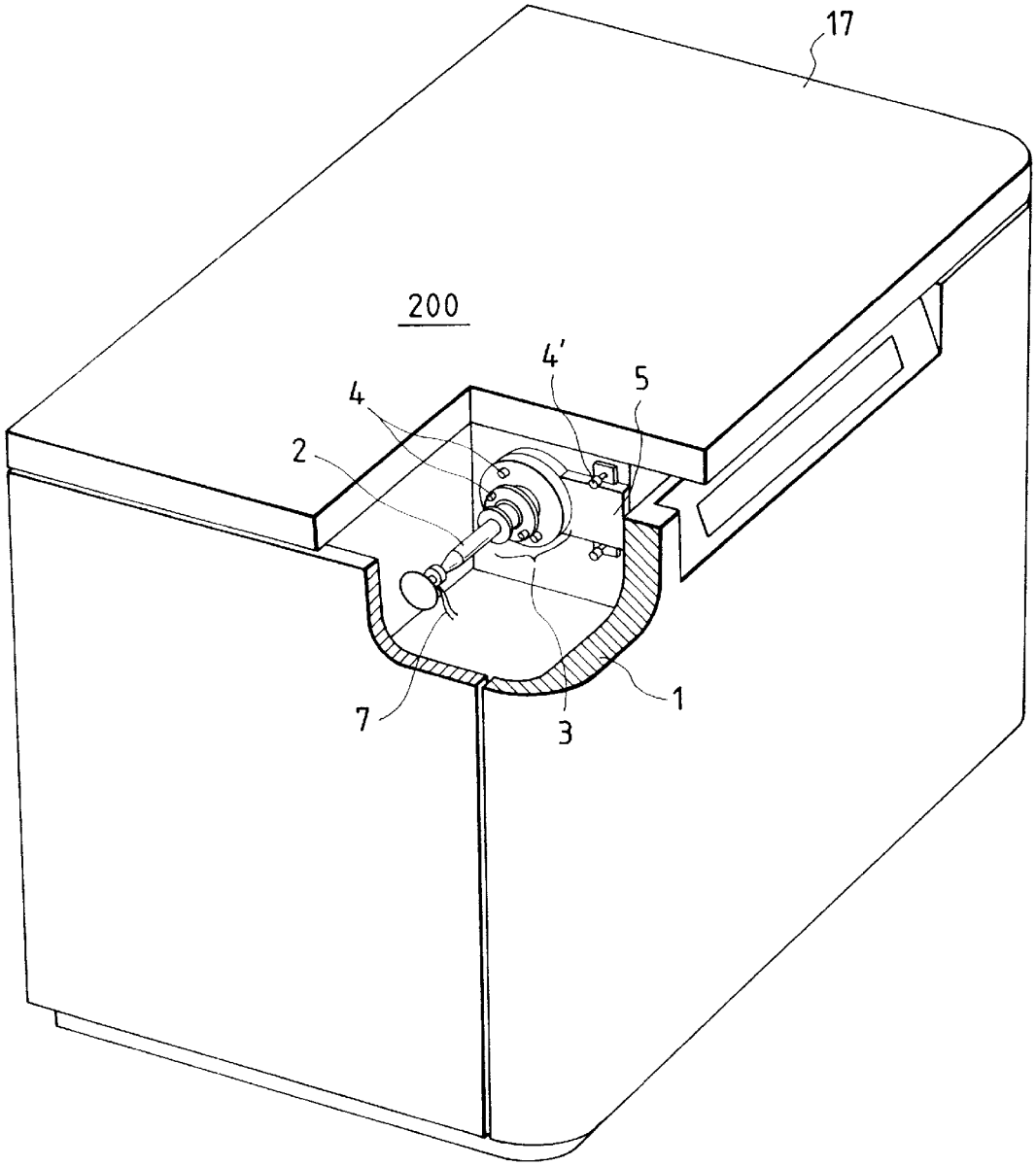
FIG. 21 (PRIOR ART)
FIG. 21 is a perspective view depicting the arrangement of an interface mechanism in the mass analyzer of a conventional structure.

FIG. 8 is a perspective view of the composition of the interface mechanism of the mass analyzer of the second embodiment of the present invention; and FIG. 9 is a decomposition view of the interface mechanism of FIG. 8. In FIGS. 8 and 9, 21 represents a groove part; 22 represents a table part; and 23 represents a supporting bar. Other symbols are the same as in the embodiment of FIGS. 2 and 3.

The interface mechanism of the mass analyzer of the second embodiment of the present invention, as shown in FIGS. 8 and 9, is another embodiment of the present invention applied to the interface mechanism, having a structure such that individual fine pore electrodes composing the ionizing electrode 3 are arranged on table part 22 of an approximately square pole shape by means of supporting bar 23 and the table part 22 is arranged on the groove part 21 arranged on the plane plate 16 of the box 1 of the body.

More specifically, the ionizing electrode 3 of the interface mechanism of the mass analyzer of the second embodiment of the present invention is of a structure such that the individual fine pore electrodes are arranged on the table part 22 of an approximately square pole shape by means of the supporting bar 23 and the table part 22 is arranged on the groove part 21 arranged on the plane plate 16 of the box 1 of the body. As shown in FIG. 9, then, the individual fine pore electrodes composing the ionizing electrode 3 are capable of sliding in the groove part 21 arranged on the plane plate 16 of the box 1 of the body and are removable upward, and by arranging the individual fine pore electrodes in the groove part 21, the positioning of the centers of the fine pores can be carried out. At a state during use, additionally, the individual fine pore electrodes composing the ionizing electrode 3 are wholly fixed on the face of vacuum duct 5 by means of fixing screw 4, while the electrodes are pressed and fixed in engagement to the groove part 21 against the face of the vacuum duct 5, by means of stopper 12 expanding with a spring inside.

Like the first embodiment, furthermore, a given voltage is applied to the individual fine pore electrodes and the vaporizer 2 composing the ionizing electrode 3, through the cable 8 and the connector 9, from a power source inside the box 1 of the body, to feed a power source to the heater; and signals from a sensor for measuring temperature are also transmitted through the cable. Even in the embodiment shown in FIGS. 8 and 9, furthermore, microswitch 19 is arranged in engagement to the front lid 20 and the microswitch 19 similarly serves as in the embodiment described with reference to FIG. 3. In the embodiment shown in FIGS. 8 and 9, fine pore electrodes to be arranged on the side of the vacuum duct 5, among the individual fine pore electrodes composing the ionizing electrode 3, are directly arranged on the vacuum duct 5. Even the fine pore electrodes may satisfactorily be arranged on the table part by means of the supporting bar, like the other fine pore electrodes, so that the fine pore electrodes might be removable.

Even the second embodiment of the present invention can bring about the same effects as in the first embodiment.

Figure 10:
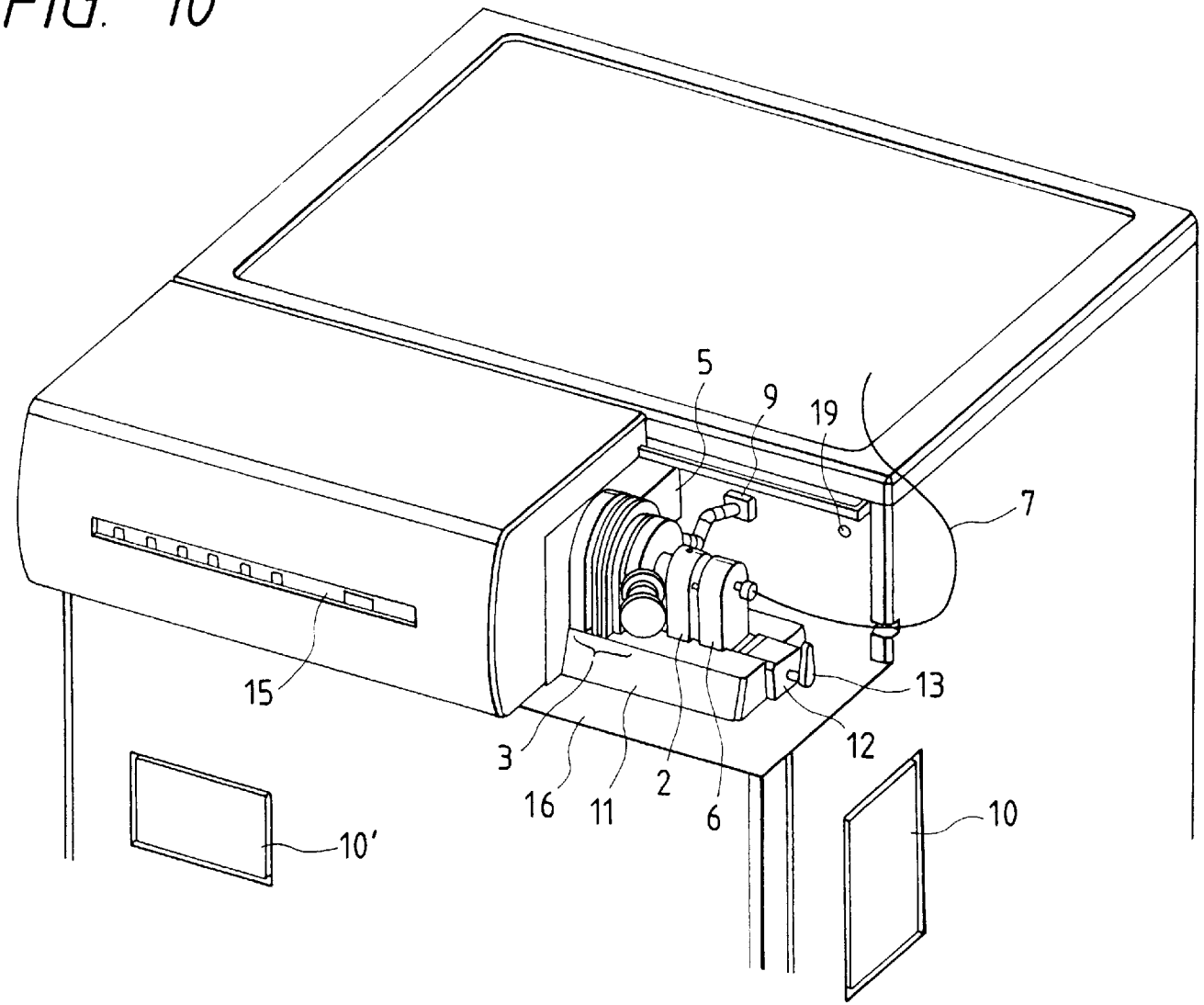
FIG. 10 is a perspective view of the composition of the interface mechanism of a mass analyzer in a third embodiment of the present invention.
Figure 11:
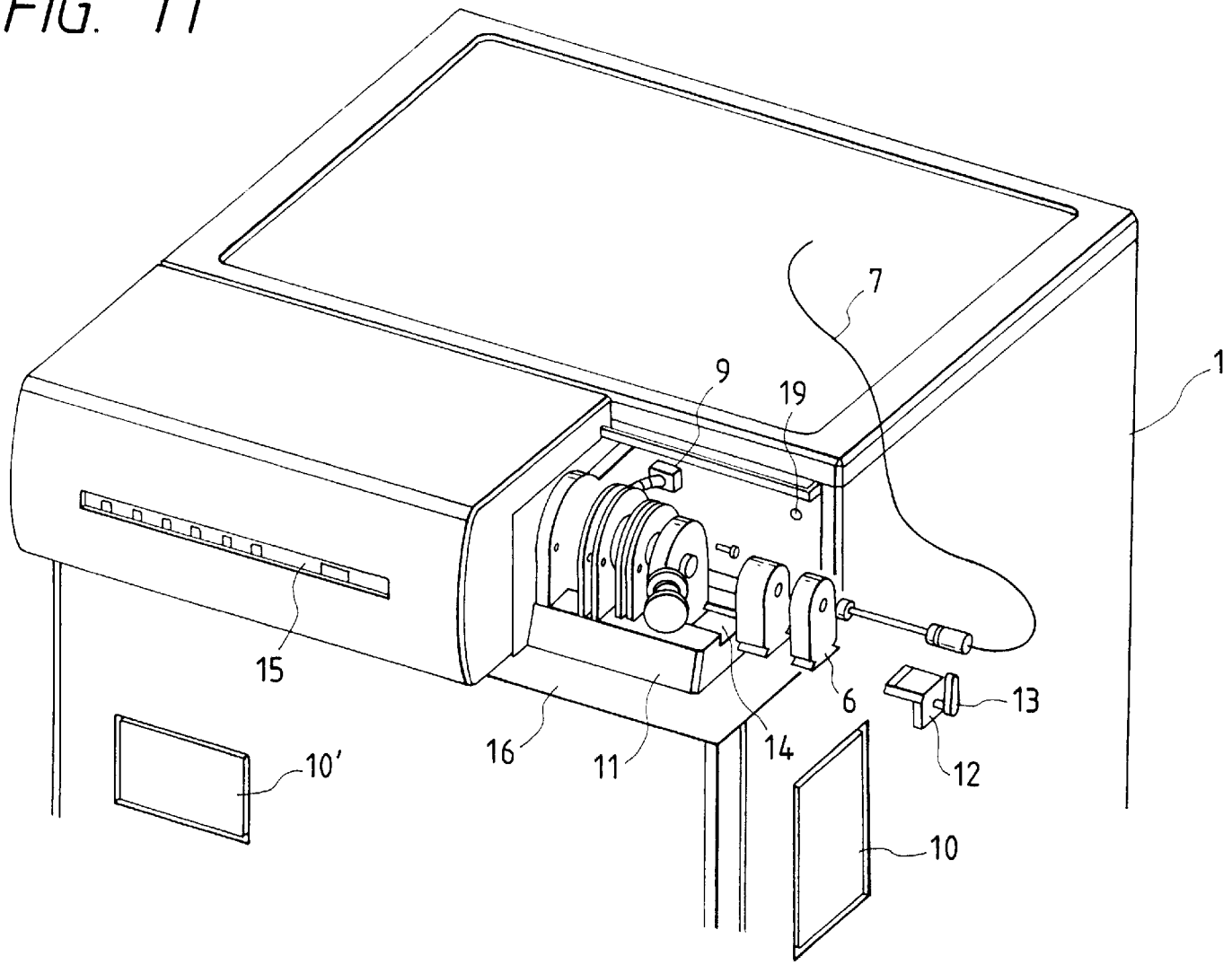
FIG. 11 is a decomposition view depicting the interface mechanism FIG. 10.

FIG. 10 is a perspective view of the composition of the interface mechanism of a mass analyzer in a third embodiment of the present invention; and FIG. 11 is a decomposition view of the interface mechanism of FIG. 10. The symbols in FIGS. 10 and 11 are the same as in the embodiment of FIGS. 2 and 3.

The interface mechanism of the mass analyzer in the third embodiment of the present invention as shown in FIGS. 10 and 11 is an embodiment of the present invention applied to the APCI interface mechanism, and like the first embodiment of the present invention, the ionizing electrode 3 has an end part of a square shape, not a disk shape, in engagement to the groove part 14 of the table 11 arranged on the plane plate 16 of the box 1 of the body; and the vaporizer 2 and the nebulizer 6 also have an end part of a square shape, not a cylindrical shape, in engagement to the groove part 14 of the table 11 arranged on the plane plate 16 of the box 1 of the body.

More specifically, the interface mechanism of the mass analyzer of the third embodiment of the present invention is of a structure such that the individual fine pore electrodes composing the ionizing electrode 3 have an end part of a square shape in engagement to the groove part 14 of the table 11 arranged on the plane plate 16 of the box 1 of the body. As shown in FIG. 11, then, the individual fine pore electrodes composing the ionizing electrode 3 and being capable of sliding on the groove part 14 arranged on the table 11 by the guide of the groove part 14, are arranged in engagement to the inside of the groove part 14, whereby the positioning of the pore centers can be carried out.

Additionally, the vaporizer 2 and the nebulizer 6 are of a structure such that the vaporizer 2 and the nebulizer 6 have an end part of a square shape to be engaged in the groove part 14 on the table 11 arranged on the plane plate 16 on the box 1 of the body and also have a shape capable of being engaged in the groove part 14. Therefore, the vaporizer 2 and the nebulizer 6 are capable of sliding by the guide of the groove part 14 arranged on the table 11, and additionally, the vaporizer 2 and the nebulizer 6 are arranged in engagement to the inside of the groove part 14, whereby the positioning of the pore centers can be done individually and the positioning thereof relative to the fine pores of the fine pore electrodes composing the ionizing electrode 3 can be carried out.

At a state during use, the individual fine pore electrodes composing the ionizing electrode 3 are fixed on the face of vacuum duct 5 by means of fixing screw 4 to fix the whole ionizing electrode 3 thereon, and the vaporizer 2 and the nebulizer 6 are pressed, against the ionizing electrode 3 by means of stopper 12 having stopper lever 13 in engagement to the groove part 14, starting from the end part of the table 11.

From a power source inside the box 1 of the body, a given voltage is applied through the cable 8 and connector 9 to the individual fine pore electrodes composing the ionizing electrode 3. From a power source inside the box 1 of the body, through the cable 8, an electric power is supplied to the vaporizer 2 and the nebulizer 6 so as to heat these devices to a given temperature. These are the cases with the first and second embodiments, and microswitch 19 also works similarly. The groove part 14 arranged on the table 11 is formed of an approximate trapezoid, whereby the upward removal of the groove part 14 is prevented when the individual fine pore electrodes, the vaporizer 2 and the fogging device 6 are at a state in engagement to the groove part 14.

In accordance with the third embodiment of the present invention, the decomposition works for cleaning and exchange and the like of the ionizing electrode 3, the vaporizer 2 and the nebulizer 6, which compose the interface mechanism, can be readily carried out, by removing the fixing screw 4 thereby removing the stopper 12 and then sliding individually a plurality of the fine pore electrodes composing the ionizing electrode 3, the vaporizer 2 and the nebulizer 6 inside the groove part 14. Additionally, the assembly works thereafter can be carried out by sliding the individual members inside the groove part 14 for secure positioning without any concern to the positioning.

Figure 12:
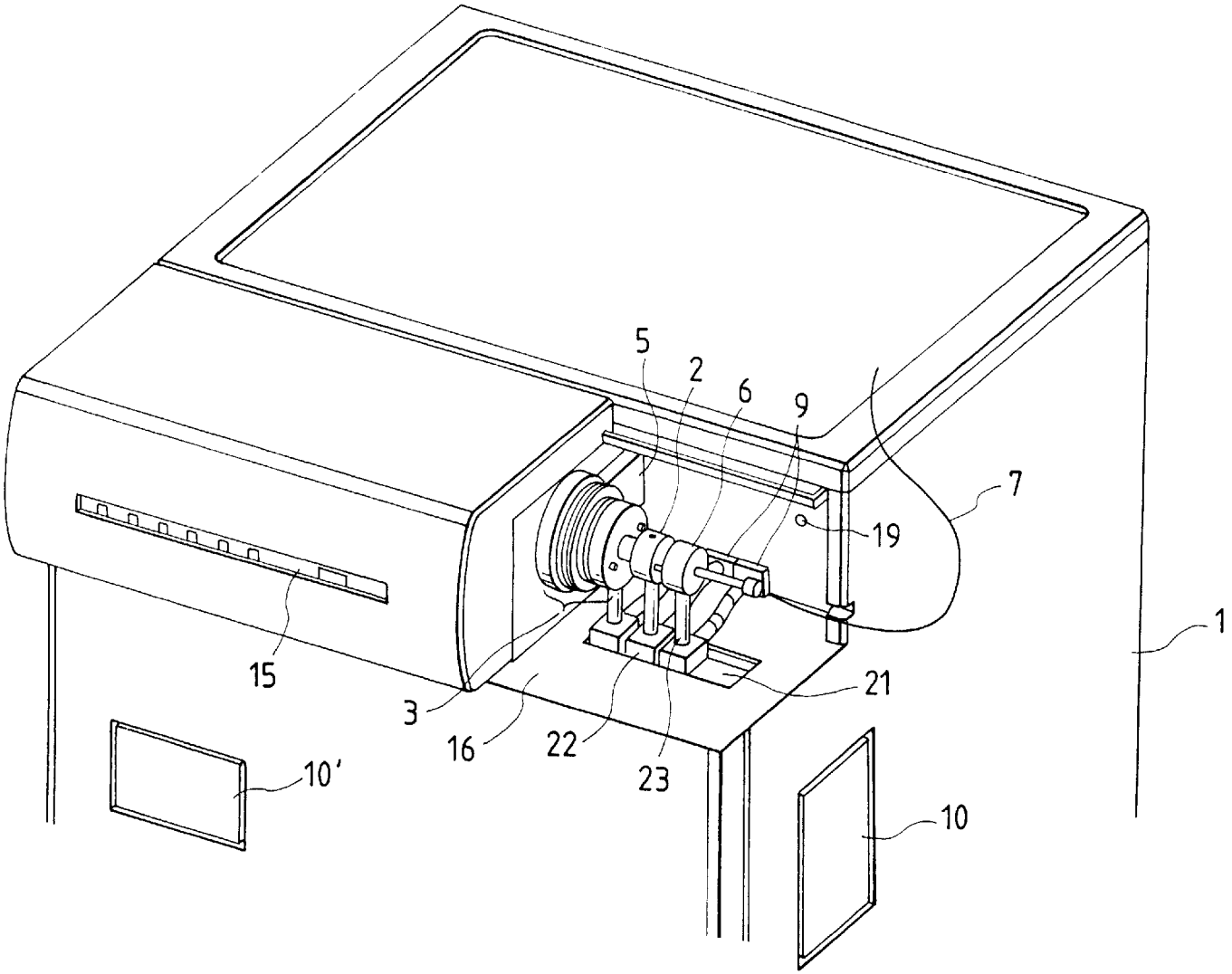
FIG. 12 is a perspective view of the composition of the interface mechanism of a mass analyzer in a fourth embodiment of the present invention.
Figure 13:
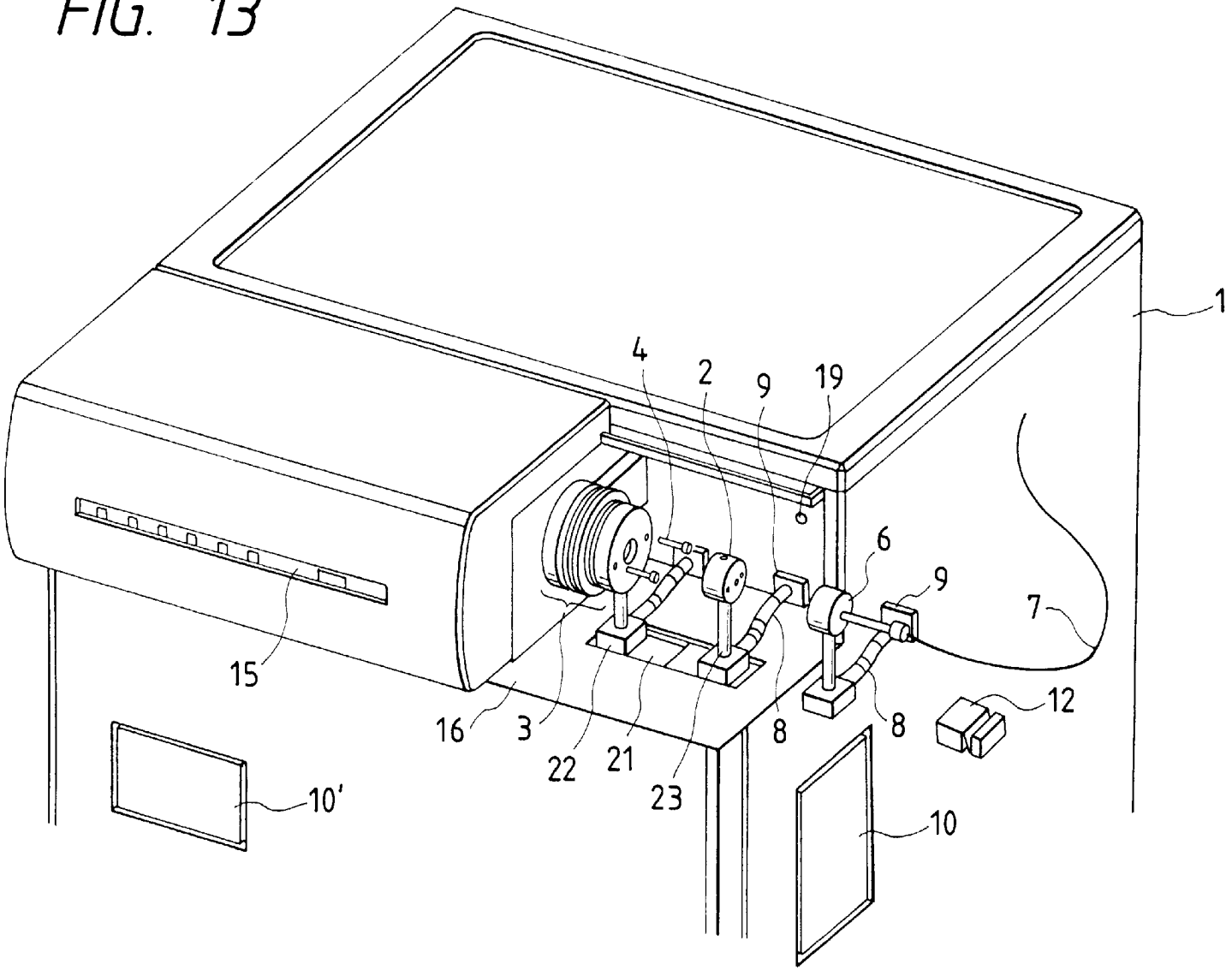
FIG. 13 is a decomposition view of the interface mechanism of FIG. 12.

FIG. 12 is a perspective view of the composition of the interface mechanism of a mass analyzer in a fourth embodiment of the present invention; and FIG. 13 is a decomposition view of the interface mechanism of FIG. 12. The symbols in FIGS. 12 and 13 are the same as in the embodiment of FIG. 8.

The interface mechanism of the mass analyzer of the fourth embodiment of the present invention as shown in FIGS. 12 and 13 is another embodiment of the present invention applied to the APCI interface mechanism, wherein the individual fine pore electrodes composing the ionizing electrode 3 are structurally arranged by means of the supporting bar 23 on the table part 22 of an approximate square pole shape and wherein the vaporizer 2 and the nebulizer 6 are arranged by means of the supporting bar 23 on the table part 22 of an approximate square pole shape. These members are arranged on groove part 21 on table part 22 mounted on plane plate 16 of the box 1 of the body.

More specifically, the ionizing electrode 3 of the interface mechanism of the mass analyzer of the second embodiment of the present invention is of a structure such that the individual fine pore electrodes are arranged on the table part 22 of an approximate square pole shape by means of supporting bar 23 and the table part 22 is arranged on the groove part 21 arranged on the plane plate 16 of the box 1 of the body. Also, the vaporizer 2 and the nebulizer 6 are structurally mounted on the table part 22 of an approximate square pole shape by means of supporting bar 23, and the table part 22 is mounted on the groove part 21 arranged on the plane plate 16 of the box 1 of the body.

As shown in FIG. 13, then, the individual fine pore electrodes composing the ionizing electrode 3, the vaporizer 2 and the nebulizer 6 are capable of sliding inside the groove part 21 arranged on the plane plate 16 of the box 1 of the body to be removable upward, and by arranging the individual fine pore electrodes, the vaporizer 2 and the nebulizer 6 inside the groove part 21, the positioning of the fine pores so as to arrange the fine pores on the centers of the individual members can be carried out. At a state during use, the individual fine pore electrodes composing the ionizing electrode 3 are fixed on the face of vacuum duct 5 by means of fixing screw 4. Furthermore, the vaporizer 2 and the nebulizer 6 may satisfactorily be fixed on the ionizing electrode 3 by means of a fixing screw not shown in the figure. Additionally, the vaporizer 2 and the nebulizer 6 are satisfactorily pressed and fixed against the side of the ionizing electrode 3, by arranging a fastening device and the like inside the groove part 21, more specifically, between the table part 22 of the nebulizer 6 and the edge of the groove part 21.

As is the case of the third embodiment, furthermore, a given voltage is applied from a power source inside the box 1 of the body, through cable 8 and connector 9, to the individual fine pore electrodes composing the ionizing electrode 3, while an electric power is fed from a power source inside the box 1 of the body through the cable 8 and the connector 9 to the vaporizer 2 and the nebulizer 6 to heat these devices at a given temperature. Furthermore, microswitch 19 also functions as in the other embodiments. In the embodiment shown in FIGS. 12 and 13, also, fine pore electrodes arranged on the side of vacuum duct 5, among the individual fine pore electrodes composing the ionizing electrode 3, are directly mounted on the vacuum duct 5, but even the fine pore electrodes may satisfactorily be mounted on the table part by means of a supporting bar, like the other fine pore electrodes, to be removable.

Even the fourth embodiment of the present invention can bring about the same effects as in the third embodiment.

Figure 14A:
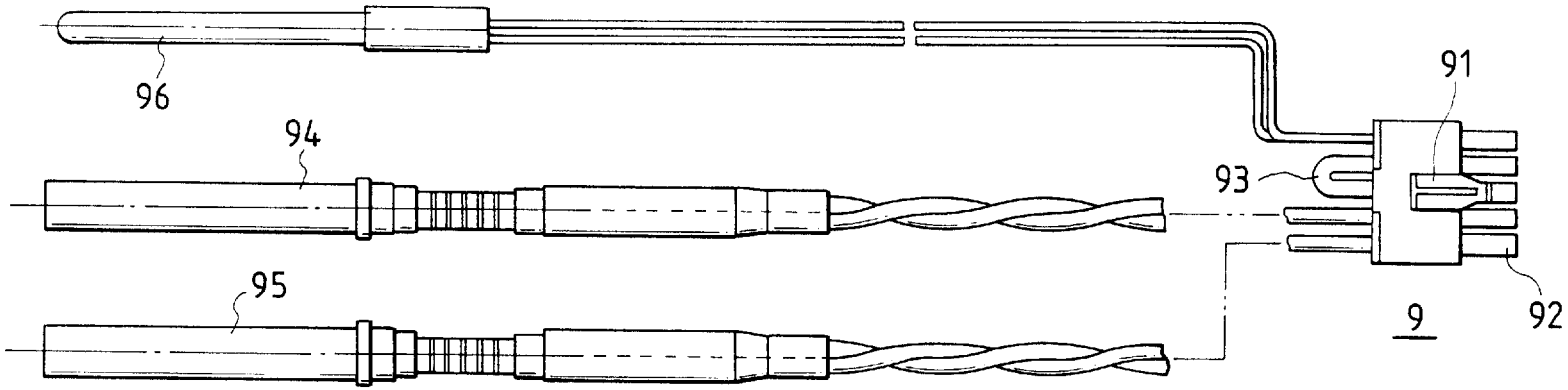
FIG. 14A is an overall view depicting the relation between connector 9 connecting between the interface mechanism as described above and the inner devices of the box 1 of the body and wiring.
Figure 14C:
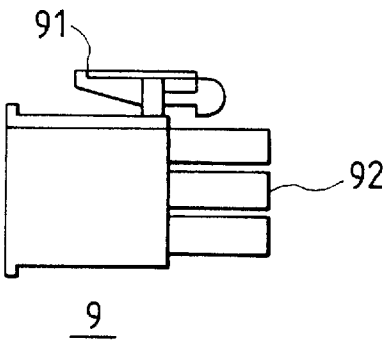
FIG. 14C is a side view depicting a connector part, which view is focused on rock nail 91 which works to prevent the removal of the connector 9 by chance.
Figure 14B:
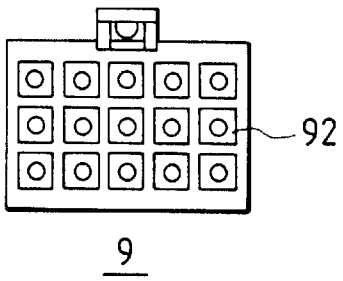
FIG. 14B is a view of the connector 9 from the side of connector pin 92.

FIG. 14A is an overall view depicting the relation between connector 9 connecting between the interface mechanism as described above and the inner devices of the box 1 of the body and wiring. In FIG. 14A, 91 represents a rock nail; 92 represents a connector pin; 93 represents a jumper line; 94, 95 represent a heater; and 96 represents a temperature sensor such as thermocouple and thermister. In the mass analyzer of the present invention, the number of heaters and sensors or the number of wirings for high-voltage application varies, depending on the ionizer type. In FIG. 14A, only two heaters and one sensor are shown, but these may be set up appropriately, depending on the number of the pins of connector 9, and as shown in the aforementioned embodiments, a plurality of cables may be satisfactory. Additionally, for the wiring for heater and sensor, a cable different from the cable of high-voltage application may be used satisfactorily. FIG. 14B is a view of the connector 9 from the side of connector pin 92, which is for example 15 pins. FIG. 14C is a side view depicting the connector part, which view is focused on rock nail 91 to prevent the removal of the connector 9 by chance.

One of the connectors 9 should be provided with jumper line 93 and the jumper line 93 is utilized in order that the type of the cable selected depending on the ionizer type can be automatically identified by the controller 400. As described above, the interface mechanism 200 is drawn out from the box 1 of the body when the interface mechanism 200 is subjected to maintenance works such as decomposition and assembly, but then, the heater and sensor arranged in the interface mechanism and the cables connected to them are drawn out by removing the connector 9 from the connection terminal 60 arranged in the box 1 of the body. More specifically, the interface mechanism, the cable 8 and the connector 9 are in the corresponding relation of 1:1. As shown in FIG. 14B, the connector 9 has a plurality of connector pins 92, for example 15 connector pins, in the embodiment shown in the figure, and the connector pins are arranged in a matrix of 3×5. A pair of connector pins 92 are assigned individually to two heaters 94, 95, and temperature sensor 96 and a high-voltage wiring not shown in the figure. Then, a pair of the remaining connector pins 92 is short circuited with the jumper line 93. A variety of types are present for the interface mechanism of the mass analyzer, and these interface mechanisms can be used in the box 1 of the same body. In that case, the principal components of the mass analyzer, which are preliminarily assembled inside the box 1 of the body, can be used in common. The cable 8 and connector 9 in connection to the interface mechanism should correspond to the interface mechanism as described above, but the form of the connector 9 is common to a variety of types of the interface mechanisms. Also, the position of the connector pin to which the heaters 94, 95 and the temperature sensor and the like are connected is not changed but the same. Alternatively, the position of the connector pin 92 short circuited with the jumper line 93 is not shown in the figure, but the position varies depending on the type of the interface mechanism, whereby the controller 400 can identify the type of the interface mechanism arranged, to correspondingly control the power supply to the heater and control the inner devices and the display control on display 33 by means of personal computer 32. Not specifically shown in the figure, herein, the identification of the type of the interface mechanism can be carried out satisfactorily, by detecting the variation in position of for example protrusions arranged on different parts of the side of the connector, instead of by detecting the position of the connector pin 92 short circuited with the jumper line 93.

Figure 15:
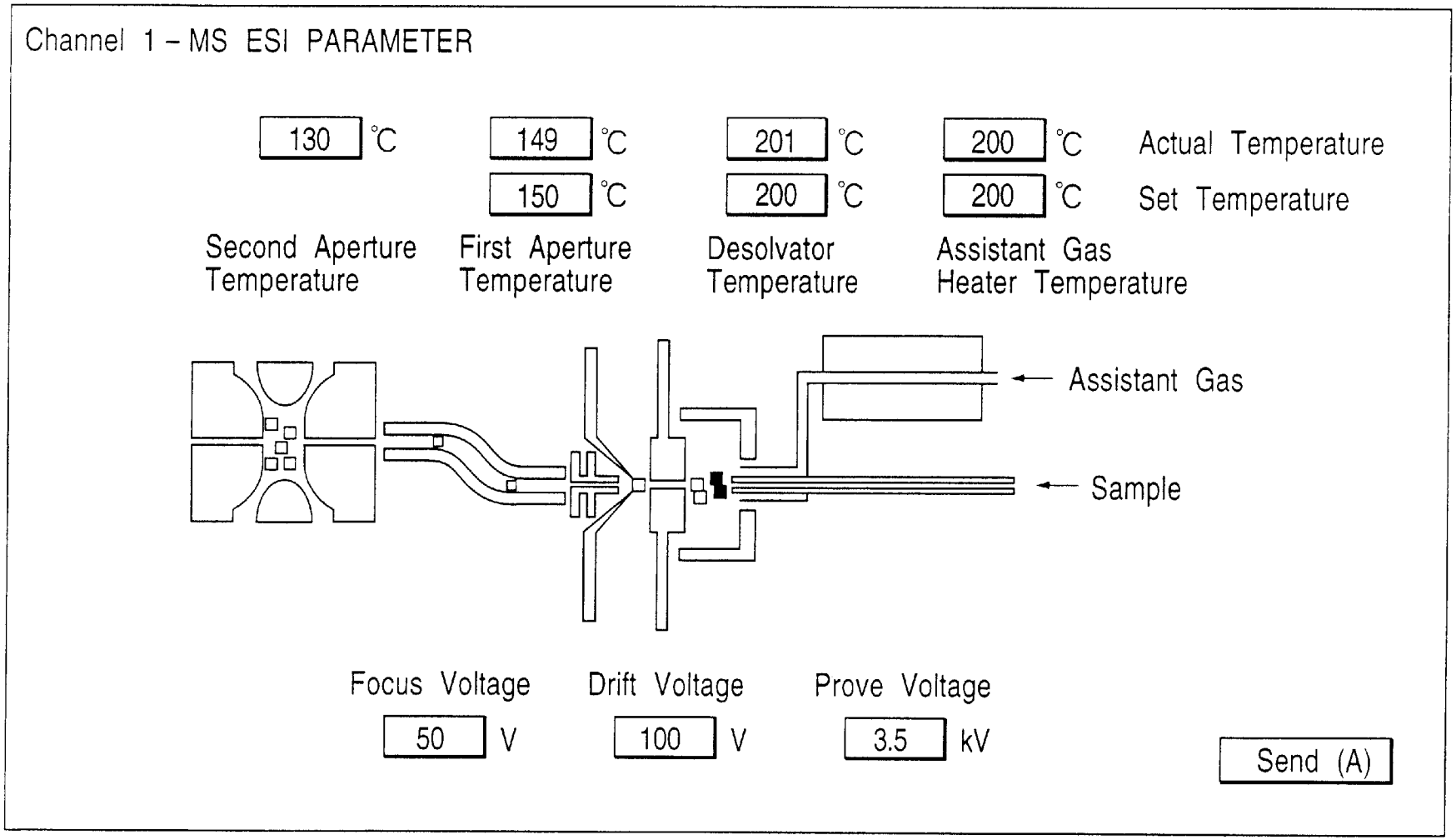
FIG. 15 is a view of a monitor display example on display when the type of an interface mechanism mounted is judged as ESI and a monitor display corresponding to the interface mechanism is displayed on display 33 of controller 400.
Figure 16:
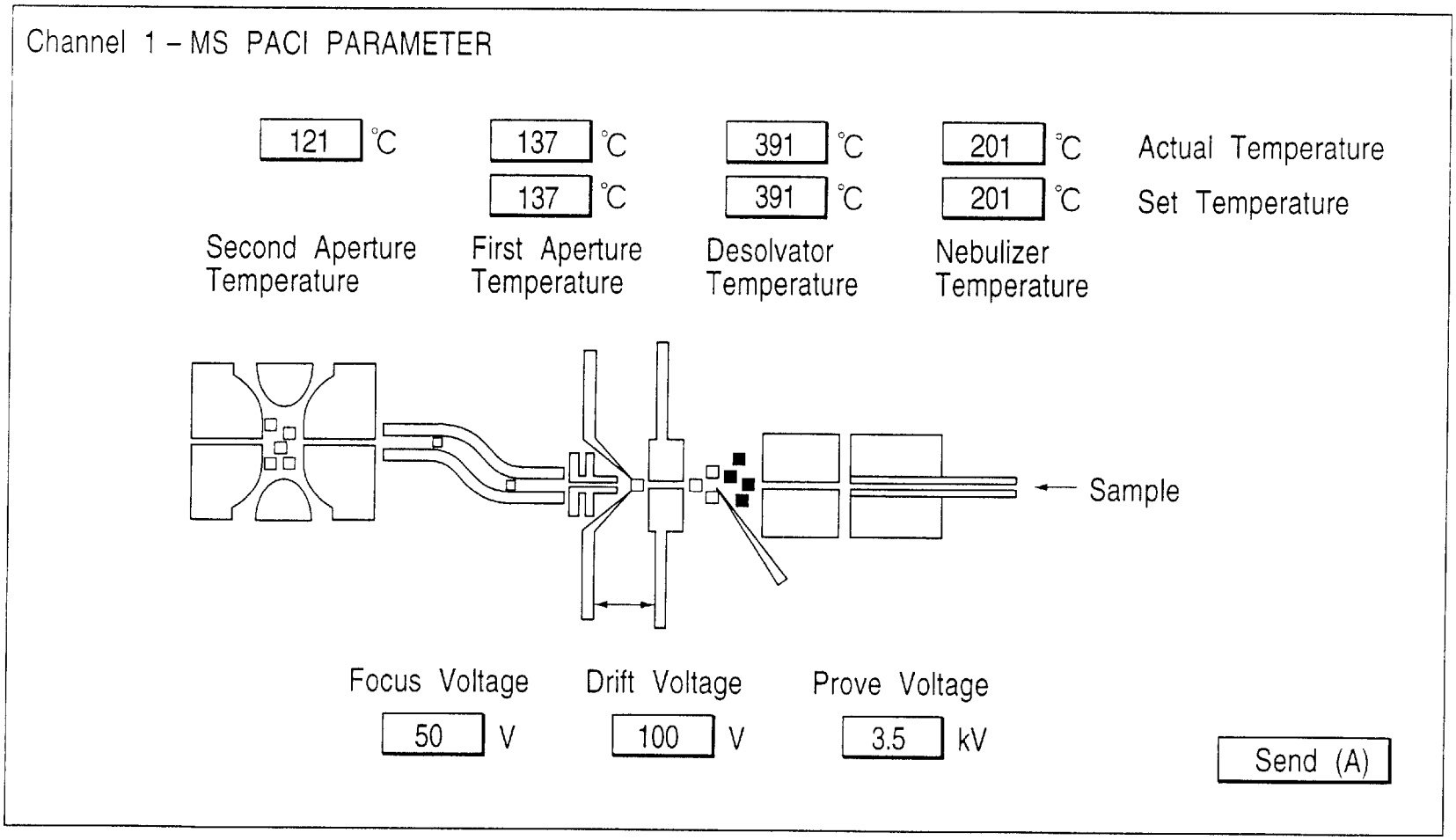
FIG. 16 is a view of a monitor display example on display when the type of an interface mechanism mounted is judged as APCI and a monitor display corresponding to the interface mechanism is displayed on display 33 of controller 400.
Figure 17:
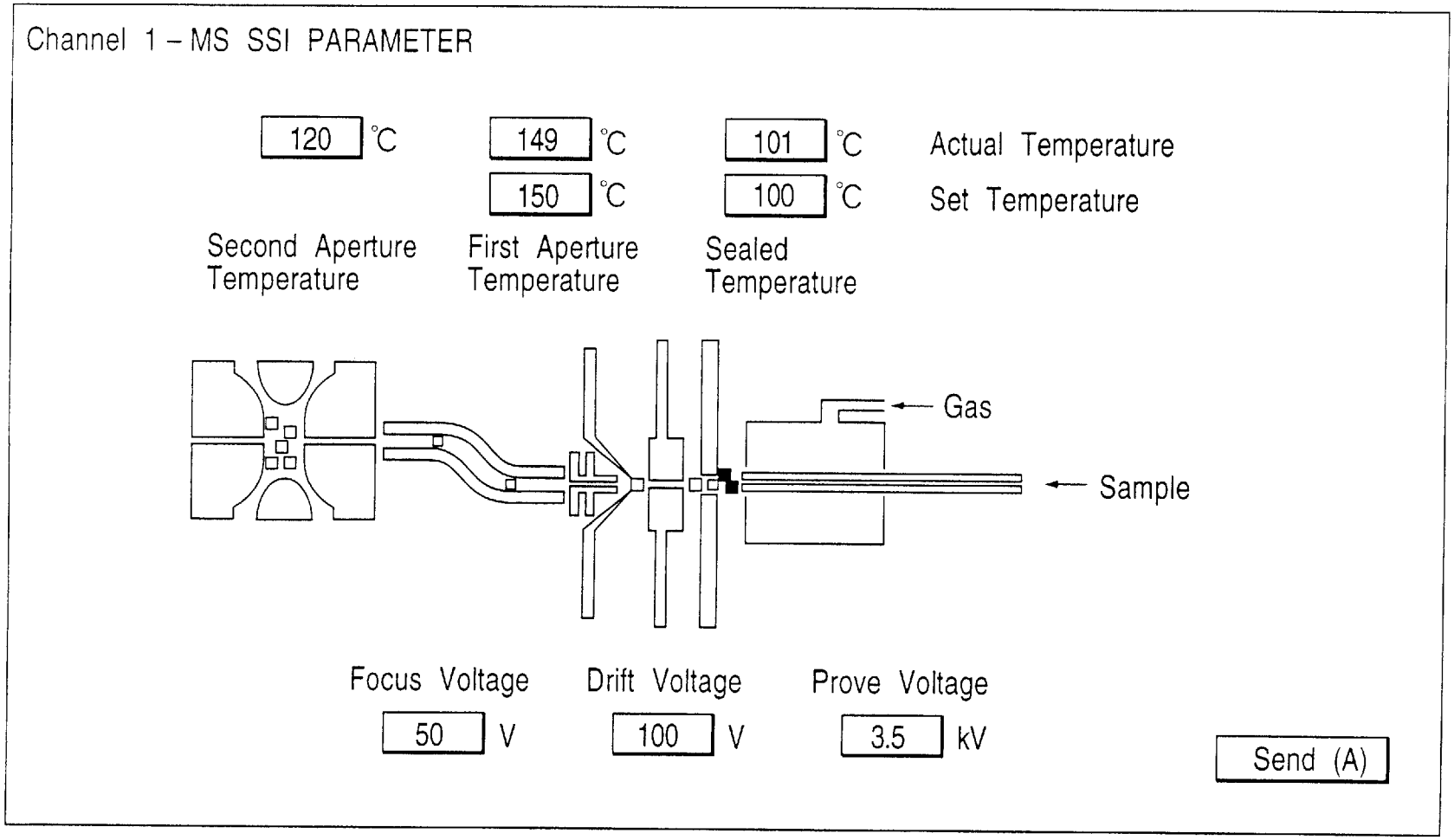
FIG. 17 is a view of a monitor display example on display when the type of an interface mechanism mounted is judged as SSI and a monitor display corresponding to the interface mechanism is displayed on display 33 of controller 400.

FIGS. 15 to 17 depict an example wherein the type of an interface mechanism arranged is determined on the basis of the connecting position of the jumper line 93, to display a monitor display corresponding to the interface mechanism on the display 33 of the controller 400.

Herein, ESI interface mechanism is to be arranged as an interface mechanism on the box 1 of the body. On the basis of the position of the connector pin 92 short circuited with the jumper line 93, the interface mechanism arranged is identified as ESI interface mechanism and as shown in FIG. 15, the schematic composition of the mass analyzer with the ESI interface mechanism is shown. Additionally, an area for displaying the value of voltage or temperature along with the data titles of the individual members is arranged around the corresponding positions. For a member requiring temperature set up, the temperature value is represented as the set-up temperature and the actually determined temperature of the member at an operation state. As to the voltage value, a measured value is shown. The figure represents detection and display to be required and programmed with a personal computer described in FIG. 1, but the detail is omitted herein. Control should naturally be programmed, depending on the detected value vs. the set-up value, but the description is also skipped.

If the interface mechanism mounted is APCI interface mechanism, representation as shown in FIG. 16 is carried out as in FIG. 15. No description is made about SSI interface mechanism in any embodiment, but representation as shown in FIG. 17 is also possible when SSI interface mechanism is mounted. These figures draw the skeleton or outline of the principal parts responsible for the analyzing functions of the analyzer and also represent significant parameters for an operator.

Figure 18:
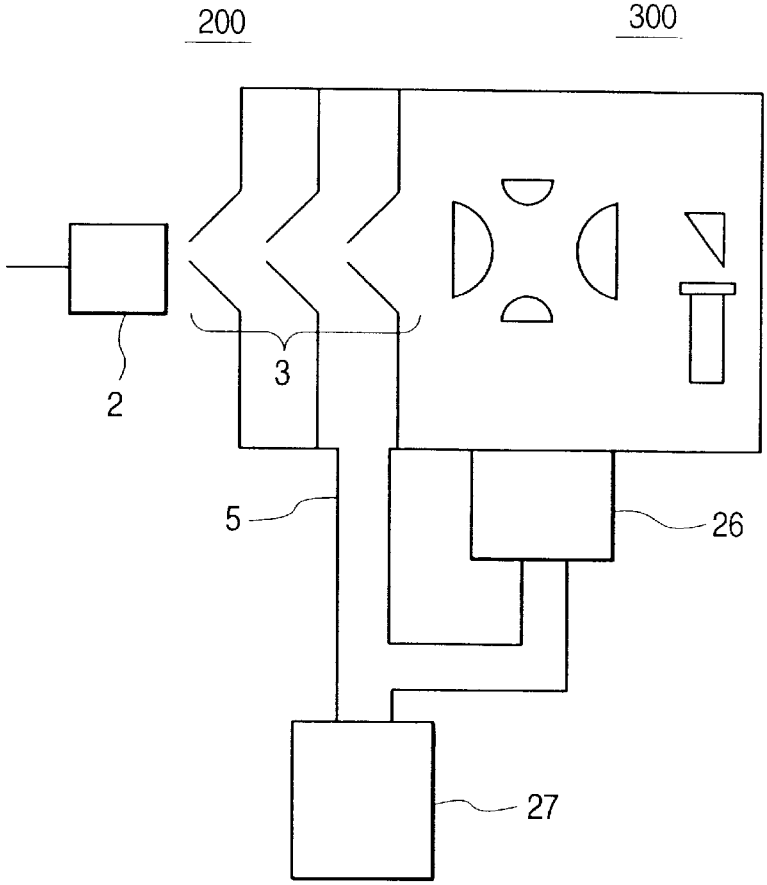
FIG. 18 is a view describing an embodiment how to use a vacuum pump in the mass analyzer of the present invention.

As described insofar, furthermore, when the set-up temperature and measured temperature of one member are to be displayed and both the values are identical, any one display of the values is to be flashed or colored differently or reversed from white to black or from black to white or flashed with a different color together with reversion between white and black, for an operator to readily identify that both the values are identical, whereby the operator is notified to start the operation of the analyzer. When the set-up value is far different from the measured value, for example, both the displays are modified as the displays described above, to notify an operator that the analyzer is not at a usable state. FIG. 18 is a view functionally describing an embodiment of arranging the interface mechanism 200 including the vaporizer 2 and the ionizing electrode 3 of the mass analyzer of the present invention, the analyzing part 300 inside the box 1 of the body and vacuum pumps 26, 27 in relation to the ion trapping part and analyzing part 300. A sample fed into the vaporizer 2 is prepared into grains, which are then ionized at the ionizing electrode 3 forming a vacuum chamber at a pressure reduced by means of vacuum duct 5, to be then introduced into the ion trapping part and analyzing part 300 preliminarily prepared as a vacuum chamber with a higher degree of vacuum for analysis. For air discharge of the individual vacuum chambers, vacuum pumps 26, 27 are arranged. The pump 26 is a turbo molecule pump; and the pump 27 is scroll vacuum pump. The inside of the vacuum chamber composing the mass analyzing part 300 is prepared at a vacuum state by means of the turbo molecule vacuum pump 26, while the inside of the vacuum chamber formed inside the ionizing electrode 3 is also prepared at a vacuum state by means of the scroll vacuum pump 27. Furthermore, the scroll vacuum pump 27 is in communication with the air discharge side of the turbo molecule vacuum pump 26, so as to discharge air from the discharged pressure from the turbo molecule vacuum pump 26, to maintain the vacuum chambers composing the mass analyzing part 300 at a higher degree of vacuum.

Figure 19:
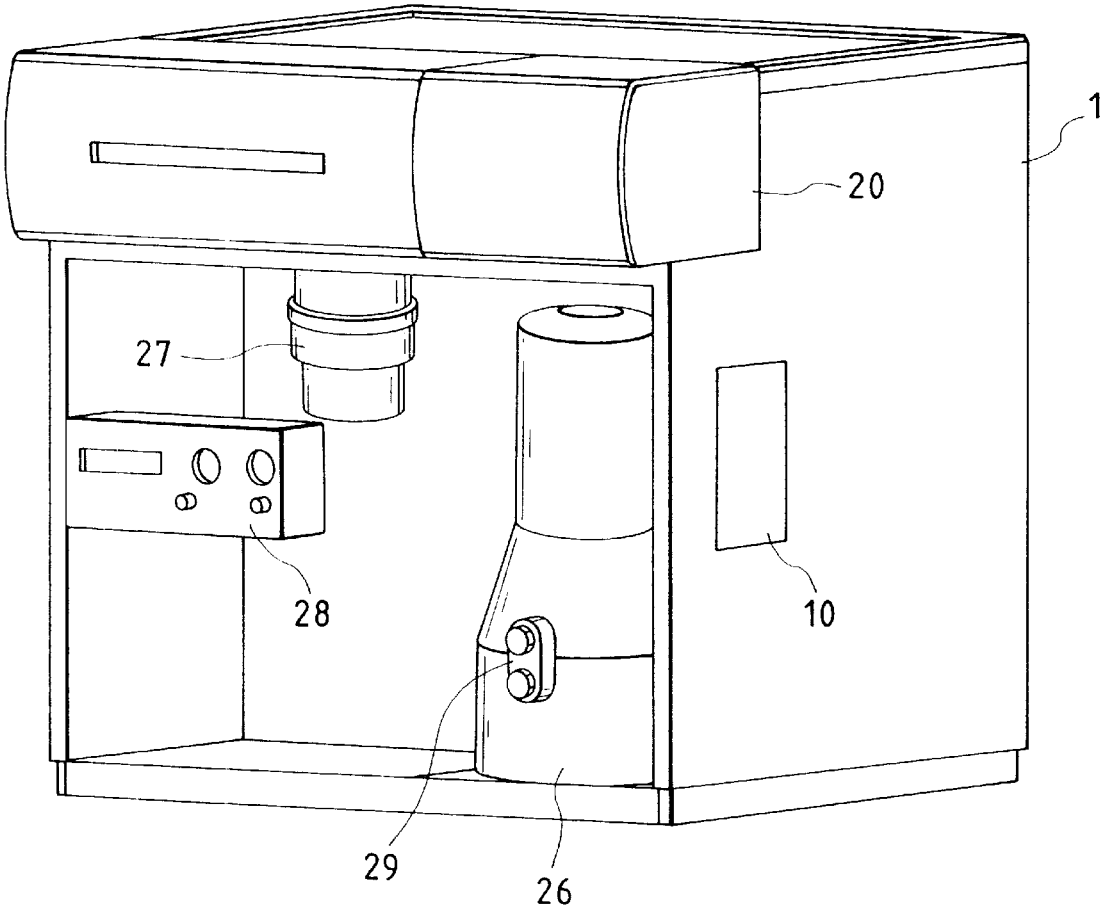
FIG. 19 is a view describing the arrangement of two vacuum pumps inside the box of the body.

FIG. 19 is a view describing the arrangement of two vacuum pumps 26, 27 inside the box 1 of the body, with the front cover on the front of the box 1 of the body having been removed. 28 represents operation part; and 29 represents indicator. The turbo molecule vacuum pump 26 is arranged on the forward side of the front of the box 1 of the body and in the example in the figure, the turbo molecule vacuum pump 26 is arranged on the bottom of the box on right side. Then, at a front position of indicator 29 indicating the volume of a hydraulic oil on the box 1 of the body is arranged transparent window 18 described in FIG. 1, while an oil supply opening of the turbo molecule vacuum pump 26, not shown in the figure, is positioned at the door 10 arranged on the side of the box 1 of the body. The turbo molecule vacuum pump 26 is arranged removable on the box 1 of the body. Also, the scroll pump 27 is mounted on the ceiling part of the box 1 of the body approximately in the forward center of the front of the box 1 of the body, to be connected directly to the vacuum chamber formed in the ionizing electrode 3.

In the present embodiment, two vacuum pumps are described as turbo molecule vacuum pump and scroll vacuum pump, but any vacuum pump of any type may be used as such vacuum pump. The operation part 28 shown in FIG. 19 is arranged with a power source switch and the like, and as described in FIG. 1, the operation part 28 is operable by opening the door 10' arranged on the forward side of the box 1 of the body. By arranging vacuum pumps inside the box 1 of the body as in the present embodiment, furthermore, noise generating in the analyzer can be reduced. By composing the turbo molecule vacuum pump 26 of a large scale as removable, the analyzer can be transferred and shipped readily, by removing only the turbo molecule vacuum pump 26, and onsite assembly thereof can be readily done.

As has been described insofar, in accordance with the present invention, the interface mechanism of the mass analyzer is of a structure such that the mechanism can be opened at two or more faces thereof from the box of the body, and therefore, the exchange of the interface mechanism of itself and the decomposition works of the interface mechanism for cleaning and exchange of the members composing the interface mechanism, such as ionizing electrode, vaporizer and nebulizer, as well as subsequent assembly works thereof, can be readily done. In the aforementioned embodiments, the description of FIGS. 15 to 17 is omitted, but as readily understood on comparison of these figures with FIG. 18, the principal parts of the analyzer are drawn as the skeleton in these figures, while data is represented around the devices requiring the set up of temperature and voltage or requiring monitoring.

Still furthermore, the present invention can be carried out in a variety of embodiments as described below.

1. A connector connecting between the cables to the interface mechanism for feeding a heating power supply and the inside of the box is used, so as to identify the type of the interface mechanism. More specifically, the position of connector pins short circuited with a jumper line varies, depending on the type of the interface mechanism to be used, whereby the type of the interface mechanism mounted can be automatically detected, to carry out the feeding of electric power to the heater, the control of the inner devices and the display control of personal computer 32 on display 33, in a corresponding manner to the type of the interface mechanism.

2. By composing a scroll vacuum pump arranged in a vacuum chamber formed inside the ionizing electrode to be used for air discharge from discharged pressure of a turbo molecule vacuum pump arranged in a vacuum chamber where the mass analyzing part is arranged, only two vacuum pumps are required for the mass analyzer, whereby the number of the parts in the whole analyzer can be reduced, leading to the cost reduction, and the production of an analyzer of a small-scale and a light weight.

3. Because two vacuum pumps are placed inside the box of the body, noise generating in the analyzer can be reduced; because a turbo molecule vacuum pump of a large scale is composed as removable, the analyzer can be transferred and shipped readily, after the turbo molecule vacuum pump is singly drawn out, and the onsite assembly thereof can be done readily.

What is claimed is:

1. A mass analyzer comprising a sample preparation mechanism for preliminarily preparing an analyzing sample, an interface mechanism for vaporizing or nebulizing the preliminarily prepared sample into ions, an ion trapping and analyzing part for trapping and analyzing the ions, and a controller for providing set-up values for operation of at least one of the sample preparation mechanism, the interface mechanism and the ion trapping and analyzing part and for collecting the data of the status thereof so as to provide control signals thereto, the interface mechanism is structurally placed in a box portion of a body of the mass analyzer; and wherein two or more faces of a front, side and top face of the interface mechanism are structurally opened when a part of the box portion of the body which covers the interface mechanism is removed while the ion trapping and analyzing part remains covered by another part of the box portion and the body.

2. A mass analyzer according to claim 1, wherein the interface mechanism is provided with means to vaporize or nebulize the sample and means including an ionizing electrode to prepare the sample into ions; and wherein the ionizing electrode is fixed with a structural material supporting the ionizing electrode and the structural material has an end shape in engagement to the groove part of a table arranged on a plane plate of the box portion of the body.

3. A mass analyzer according to claim 2, wherein the structural material supporting the ionizing electrode and the groove part of the table are in engagement to each other so that the ionizing electrode can slide in the groove part.

4. A mass analyzer according to claim 1, wherein the interface mechanism is provided with means to vaporize or nebulize the sample and means including an ionizing electrode to prepare the sample into ions;

wherein the ionizing electrode is fixed with a structural material supporting the ionizing electrode and the structural material has an end shape in engagement to a groove part of a table arranged on a plane plate of the box portion of the body; and wherein individual parts of the interface mechanisms are structurally integrated together by means of a stopper in engagement to the groove part of the table.

5. A mass analyzer according to claim 1, wherein the interface mechanism is provided with means to vaporize or nebulize the sample and means including an ionizing electrode to prepare the sample into ions;

wherein cables for temperature control and voltage application required for individual parts of the interface mechanism are connected, through a connector removable from the box portion of the body; and wherein a functional type of the interface mechanism can be identified on the basis of the structure of the connector.

6. A mass analyzer according to claim 5, wherein the connector is of a structure such that a specific pin position of the connector is short circuited with a jumper line.

7. A mass analyzer comprising individual members including a sample preparation mechanism for preliminarily preparing an analyzing sample, an interface mechanism for vaporizing or nebulizing the preliminarily prepared sample into ions and an ion trapping and analyzing part for trapping and analyzing the ions, and a controller for providing set-up values for the operation of the individual members and collecting data of the status of the individual members so as to provide control signals for the individual members, the controller is provided with a personal computer control member, a display input with the data of the individual members of the mass analyzer to display the control status, and an input system for inputting instructions to the personal computer control member; and a display displays principal parts of the mass analyzer which are responsible for the analyzing function in outline form and a monitor display of the data around the principal parts of the mass analyzer requiring set up and monitoring of temperature and voltage.

8. A mass analyzer according to claim 7, wherein the interface mechanism is provided with means to vaporize or nebulize the sample and means including an ionizing electrode to prepare the sample into ions;

wherein cables for temperature control and voltage application required for individual parts of the interface mechanism are connected through a connector removable from the box portion of the body.

9. A mass analyzer according to claim 8, wherein the connector is of a structure such that a specific pin position of the connector is short circuited with a jumper line.

10. A mass analyzer according to claim 7, wherein the monitor display is displayed as a combination of practically measured values and set-up values in a line.

11. A mass analyzer comprising a plurality of individual members including a sample preparation mechanism for preliminarily preparing an analyzing sample, an interface mechanism for vaporizing or nebulizing the preliminarily prepared sample into ions and an ion trapping and analyzing part for trapping and analyzing the ions, and a controller for providing set-up values for the operation of the individual members and for collecting the data of the status of the individual members so as to provide control signals for the individual members;

the ion trapping and analyzing part is structurally placed in a box portion of a body of the mass analyzer;

the mass analyzer is equipped with a vacuum pump of the ion trapping and analyzing part and a vacuum pump of the ionizing electrode part of the interface mechanism; and the vacuum pump of the ionizing electrode part of the interface mechanism further discharges the discharged air from the vacuum pump of the ion trapping and analyzing part.

12. A mass analyzer according to claim 11, wherein the vacuum pump of the ion trapping and analyzing part is removable from the box portion of the body.

13. A mass analyzer comprising a plurality of individual members including a sample preparation mechanism for preliminarily preparing an analyzing sample, an interface mechanism for vaporizing or nebulizing the preliminarily prepared sample into ions and an ion trapping and analyzing part for trapping and analyzing the ions, and a controller for providing set-up values for operation of the individual members and collecting data of the status of the individual members so as to provide control signals for the individual members;

the interface mechanism is connected to and arranged in a box portion of a body of the mass analyzer and is covered with a front lid in engagement with the box portion of the body; and a top and side of the interface mechanism, a front and top thereof, a front and side thereof or a top, front and side thereof are kept at an open state when the front lid is removed while the ion trapping and a analyzing part is covered by another part of the box portion and the body.

14. A mass analyzer according to claim 13, wherein the box portion of the body is provided with a microswitch detecting the removal of the front lid and the analyzer is operable only when the front lid is mounted.

15. A mass analyzer comprising a casing housing an interface mechanism for vaporizing or nebulizing a sample into ions and an ion trapping and analyzing part for trapping and analyzing the ions, the interface mechanism being housed within and covered by the casing separately from the ion trapping and analyzing part housed within and covered by the casing and separated therefrom by at least one partition member of the casing, the casing in the region of the interface mechanism having at least two faces of a front face, side face and top face which two faces are removable so as to enable access to the interface mechanism while the ion trapping and analyzing part remains housed and covered by the casing.

16. A mass analyzer according to claim 15, wherein the interface mechanism is provided with means to vaporize or nebulize the sample and means including an ionizing electrode for preparing the sample into ions, the ionizing electrode being fixed with a structural material supporting the ionizing electrode and the structural material has a portion engageable with a groove portion of a table arranged on a planar plate portion forming the partition member of the casing.

17. A mass analyzer according to claim 16, wherein the structural material supporting the ionizing electrode and the groove portion of the table are engageable so that the ionizing electrode is slidable in the groove portion.

18. A mass analyzer according to claim 16, further comprising a stopper member engageable with the groove portion of the table.

* * * * *